US006327718B1

(12) United States Patent
Ono et al.

(10) Patent No.: US 6,327,718 B1
(45) Date of Patent: Dec. 11, 2001

(54) BIDET

(75) Inventors: Hideki Ono, Nara; Hiroaki Yonekubo, Kyoto; Ryuta Kondo, Nara; Hideho Shinoda, Kyoto; Shinichi Maruyama, Nara, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/381,832

(22) PCT Filed: Apr. 1, 1998

(86) PCT No.: PCT/JP98/01495

§ 371 Date: Jan. 4, 2000

§ 102(e) Date: Jan. 4, 2000

(87) PCT Pub. No.: WO98/44209

PCT Pub. Date: Oct. 8, 1998

(30) Foreign Application Priority Data

| | | |
|---|---|---|
| Apr. 2, 1997 | (JP) | 9-83617 |
| Apr. 24, 1997 | (JP) | 9-107008 |
| May 21, 1997 | (JP) | 9-130760 |
| Jun. 3, 1997 | (JP) | 9-144384 |

(51) Int. Cl.[7] ..... E03D 9/08
(52) U.S. Cl. ..... 4/420.2
(58) Field of Search ..... 4/420.2, 420.4, 4/420.5

(56) References Cited

U.S. PATENT DOCUMENTS 5,826,282 * 10/1998 Matsumoto et al. ..... 4/420.2 X

FOREIGN PATENT DOCUMENTS

| | | |
|---|---|---|
| 1-318623 | 12/1989 | (JP) . |
| 1-42757 | 12/1989 | (JP) . |
| 2-3860 | 1/1990 | (JP) . |
| 3-51847 | 8/1991 | (JP) . |
| 3-212526 | 9/1991 | (JP) . |
| 3-257231 | 11/1991 | (JP) . |
| 5-33377 | 2/1993 | (JP) . |
| 6-257201 | 9/1994 | (JP) . |
| 6-264486 | 9/1994 | (JP) . |
| 7-229189 | 8/1995 | (JP) . |
| 9-32085 | 2/1997 | (JP) . |

* cited by examiner

*Primary Examiner*—Charles E. Phillips
(74) *Attorney, Agent, or Firm*—Wenderoth, Lind & Ponack, L.L.P.

(57) ABSTRACT

An apparatus for washing human privates including a water heater (12), which is connected with a water supply pipe (8) and a hot water pipe (15) such that wash water supplied from the water supply pipe (8) is heated to a proper temperature by the water heater (12) while proceeding to the hot water pipe (15) through the water heater (12). A water supply controlling device (9, 10) controls the supply of wash water to the water heater (12). A discharge device (17) is provided for discharging to the human privates the wash water heated to the proper temperature by the water heater (12), which is connected with the hot water pipe (15). An air mixing device (21) is employed for mixing air into the wash water, and a controller (32) selectively controls the amount of air mixed into the wash water by the air mixing device (21).

15 Claims, 20 Drawing Sheets

BIDET

BACKGROUND OF THE INVENTION

1. Technical Field

The present invention relates to a human privates washing apparatus for washing human bodies with hot water.

2. Description of Related Art

A conventional human privates washing apparatus of this kind is shown in FIG. 28 as disclosed in, for example, Japanese Patent Laid-Open Publication No. 5-33377 (1993). FIG. 28 is a schematic view showing a supply system of wash water, in which a water supply pipe 152 is connected with an upstream side of a pump 151 and an air mixing portion 153 is mixed with a downstream side of the pump 151. The air mixing portion 153 includes a cylindrical suction head 154 made of ceramic such that air delivered from a compressor 155 is mixed into water in the suction head 154. By this arrangement, wash water supplied from the water supply pipe 152 is pressurized by the pump 151 and proceeds to the air mixing portion 153. In the air mixing portion 153, air supplied from the compressor 155 is divided into fine portions so as to flow into the wash water. Then, the wash water having passed through the air mixing portion 153 proceeds to a heat exchanger 156. The wash water heated to a proper temperature by the heat exchanger 156 is supplied to a nozzle device 157 so as to be injected towards human privates. By this function, the wash water injected from the nozzle device 157 contains air bubbles and thus, mild bodily sensation is obtained at the time of washing of the human privates.

However, in the above mentioned conventional human privates washing apparatus, control of the compressor 155 and control of the heat exchanger 156 are not associated with each other. Therefore, if ratio of amount of the wash water to amount of air is not proper, a large amount of air is collected, thus resulting in local boiling or abnormal heating in the heat exchanger 156. Meanwhile, since control of the compressor 155 and control of the heat exchanger 156 are not integrated, a user should perform a plurality of operations and cannot fully operate the conventional human privates washing apparatus unless the user is skilled in operational sequences or timings corresponding to situations. Furthermore, such a problem arises that any measure for reducing power consumption is not taken.

Meanwhile, since air bubbles are integrated with each other so as to become larger in diameter while proceeding from the air mixing portion 153 to the nozzle device 157, hot wash water is injected intermittently from the nozzle device 157, thereby resulting in uncomfortable sensation during use or scattering of the wash water. In addition, such an inconvenience is incurred that it is impossible to lessen heating quantity through reduction of heat dissipation of the heat exchanger 156.

Conventionally, generally known water heaters for human privates washing apparatuses are divided into a hot water storage type in which a fixed amount of water stored in a tank is at all times heated to and kept at a proper temperature by a heater and an instantaneous heating type in which supplied water is instantaneously heated such that hot water heated to a proper temperature is fed. A hot water storage type water heater is shown in FIG. 29 as disclosed in Japanese Patent Publication No. 2-3860 (1990). In FIG. 29, a lid 163 is securely fixed to an upper open end of a hot water storage tank 161 of a water heater 162 by a fastening member (not shown). A water inlet pipe 164 is attached to the lid 163. One end of the water inlet pipe 164 is connected with a water supply source (not shown) via a water supply pipe 165, while the other end of the water inlet pipe 164 extends through the lid 163 to a vicinity of a bottom of the hot water storage tank 161. A hot water discharge portion 166 is attached to the lid 163 and has a hot water outlet 166a communicating with interior of the hot water storage tank 161. A heater 167 for heating water is inserted into the hot water storage tank 161 through the lid 163. Meanwhile, a temperature sensor 168 for detecting temperature of hot water is mounted on the lid 163 such that a temperature sensing portion 168*a* is inserted into the hot water storage tank 161. Power supply to the heater 167 is controlled in accordance with temperature of the hot water detected by the temperature sensor 168 such that the hot water in the hot water storage tank 161 is at all times kept at a preset temperature of, for example, about 40° C.

However, in the conventional hot water storage type water heater of the above described arrangement, since the amount of stored hot water is limited, hot water having the preset temperature is supplied until the amount of discharged water exceeds the amount of stored hot water. However, if this water heater is used for a such a long time that the amount of discharged water exceeds the amount of stored hot water, temperature of the hot water starts to drop gradually. Namely, if the amount of discharged water exceeds the amount of stored hot water, most of the hot water heated by the heater 167 and stored in the hot water storage tank 161 is discharged from the hot water storage tank 161 and water having flowed into the hot water storage tank 161 after start of discharge of the hot water is discharged. As a result, temperature of the hot water discharged from the hot water storage tank 161 starts to drop gradually. This happens because water having flowed into the hot water storage tank 161 immediately after start of use of the hot water is heated to vicinity of the preset temperature to some extent but water having subsequently flowed into the hot water storage tank 161 is discharged almost without being heated. Hence, since hot water having a temperature lower than the preset temperature is discharged, there is a risk that uncomfortable sensation is given to a user during washing of the body. Therefore, the hot water storage type water heater 162 has such a drawback that since the water heater 162 can be used only for a case in which period for discharging hot water is short, the human body cannot be washed satisfactorily with hot water having the proper temperature unless washing period is shortened and the water heater 162 is used intermittently.

In order to solve the above described problems in case the hot water storage tank 161 of the hot water storage type water heater 162 cannot be made large, an instantaneous heating type water heater disclosed in, for example, Japanese Utility Model Publication No. 1-42757 (1989) as shown in FIG. 30 is adopted. A water heater 179 shown in FIG. 30 is constituted by a metallic heating tank 180 formed into a cylindrical shape having a bottom and a hot water storage cylinder 181 formed into a hollow cylindrical shape. The heating tank 180 is accommodated in the hot water storage cylinder 181 such that a hot water storage portion 181*a* is defined above the heating tank 180. An open end of heating tank 180 is fitted into one opening of the hot water storage cylinder 181 such that the heating tank 180 is communicated with the hot water storage cylinder 181 via a through-hole 182 formed on a peripheral edge of the heating tank 180 adjacent to the open end. Then, a hollow cylindrical ceramic heater 183 including an electric heating element formed by performing printing on its surface or between two ceramic substrates is communicated with a water supply line (not shown) so as to be loosely fitted thereinto. The opening of the hot water storage cylinder 181 is closed by a flange of the ceramic heater 183. The other opening of the hot water storage cylinder 181 is closed by a housing 186 including a float switch 184 and a vacuum switch 185 such that the housing 186 is communicated with the hot water storage cylinder 181. Thus, hot water is discharged from a hot water discharge pipe 187 fixed to the housing 186. A temperature sensor 188 for detecting temperature of hot water heated by the ceramic heater 183 is mounted above the through-hole 182 formed on the heating tank 180.

In the instantaneous heating type water heater 179, since water proceeding through an inner periphery of the ceramic heater 183 into the heating tank 180 can be instantaneously heated to a preset temperature by the electric heating element of the ceramic heater 183, namely, the water flowing into the heating tank 180 can be continuously heated to the preset temperature during flow of the water, hot water having a fixed temperature can be continuously discharged for a long time advantageously. On the other hand, breakers for protecting overcurrent are installed on houses in general. In order to prevent trip of the breakers, wattage of the heater should be set to be not more than about 1200 W at AC 100 V. In case hot water having, for example, 40° C. is used, discharge rate should be not more than about 400 cc/min. in order to raise temperature of water by 40 degrees in view of winter season in which temperature of water supplied to the water heater is low. In the instantaneous heating type water heater of the above described arrangement, as diameter of the hollow cylindrical ceramic heater 183 is reduced further, production of the ceramic heater 183 becomes more difficult and its heat transfer area becomes smaller, so that there is a limit to diameter of the ceramic heater 183. Therefore, water storage portions in which water is collected are produced in water passages of the heating tank 180, the hot water storage cylinder 181, etc. which have volumes corresponding to size of the ceramic heater 183. For example, even if discharge rate is about 200 cc/min., its thermal capacity becomes large due to the water storage portions and water is collected in the water storage portions which are not so small as the discharge rate of not more than about 400 cc/min. As a result, such a disadvantage is incurred that since not only a long time period is required for raising temperature and effecting response in temperature control but flow velocity becomes small due to large cross-sectional areas of inner and outer peripheral flow paths of the ceramic heater 183 as compared with the above discharge rate, heat transfer rate deteriorates, thereby resulting in deterioration of thermal efficiency of the water heater.

Meanwhile, in addition to the inconvenience that period for discharging hot water is limited, the human privates washing apparatus including the above mentioned hot water storage type water heater has a drawback that the apparatus becomes large in size due to the hot water storage tank and a disadvantage that since power supply should be performed all day long such that the apparatus can be used any time, loss caused by heat dissipation due to storage of hot water occupies a major portion of whole power consumption, thus resulting in extreme rise of its running cost. On the other hand, the human privates washing apparatus including the instantaneous heating type water heater of the above described arrangement has been disadvantageous in that since volume of the heating tank becomes large due to size of the hollow cylindrical ceramic heater, it is difficult to make the apparatus compact and that since control response is poor due to the water storage portions, it is difficult to instantaneously change set temperature during washing.

In addition, conventionally, a flow rate sensor and a human privates washing apparatus including the flow rate sensor are disclosed in, for example, Japanese Patent Laid-Open Publication No. 6-264486 (1994) as shown in FIG. 31. The conventional flow rate sensor is described with reference to FIG. 31. FIG. 31 is a cutaway front elevational view of the flow rate sensor. In FIG. 31, a flow rate sensor 201 is constituted by a body 204 having an inflow path 202 and an outflow path 203, an impeller 206 rotatably supported by a shaft 205 mounted on the body 204 and a photo interrupter 207. The photo interrupter 207 is disposed at such a position that its optical axis passes through a peripheral edge of a side plate 208 provided on the impeller 206. Light is intercepted by the side plate 208 but passes through a plurality of recesses 209 formed on a peripheral edge of the side plate 208 at regular intervals such that the number of revolutions of the impeller 206 is detected.

Meanwhile, FIG. 32 is a piping diagram of a human privates washing apparatus including this flow rate sensor. In FIG. 32, a hot water storage tank 212 incorporating a heater 211 is connected with a downstream side of a water supply pump 210. Meanwhile, a washing nozzle 213 for injecting wash water to human privates is connected with a downstream side of the hot water storage tank 212 through a flow rate sensor 201. On the basis of flow rate expressed by the number of revolutions of the impeller 206 and its variations delivered from the flow rate sensor 201, a controller 214 controls drive voltage of the water supply pump 210.

However, in the known flow rate sensor of FIG. 31, since wash water for rotating the impeller 206 flows rectilinearly from the inflow path 202 to the outflow path 203, fluidal force for rotating the impeller 206 is insufficient. Therefore, at the time of low flow rate, the impeller 206 is likely to be not rotated or be rotated unstably disadvantageously. Meanwhile, if air bubbles have adhered to the impeller 206 in some form or other, the air bubbles are integrated in the vicinity of a rotary center of the impeller 206 by centrifugal force produced by rotation of the impeller 206, so that such problems arise that it is difficult to discharge the air bubbles outwardly and rotations of the impeller 206 become unstable, thereby resulting in drop of accuracy of detection of flow rate.

Meanwhile, in the conventional human privates washing apparatus of FIG. 32, since power supply to the heater 211 should be performed at all times in order to maintain temperature of wash water in the hot water storage tank 212, loss of power consumption is caused by heat dissipation. In addition, since air dissolved in the wash water in the hot water storage tank 212 is likely to appear as air bubbles upon heating and the air bubbles flow into the flow rate sensor 201, a large error is produced in value of detected flow rate due also to the above described problems.

SUMMARY OF THE INVENTION

Accordingly, the present invention has for its object to provide, with a view to eliminating the above mentioned drawbacks of prior art human privates washing apparatus, a human privates washing apparatus in which an amount of air mixed into wash water is changed in response to control of the flow rate of the wash water such that air is prevented from remaining in a heating means or a hot water pipe due to an improper mixing ratio of air. In the present invention, a user need not perform a plurality of operations, and an instantaneous heating means is employed so as to reduce loss due to heat dissipation and the amount of wash water is reduced by mixing of air thereinto such that power consumption is lessened greatly.

In order to accomplish this object, a human privates washing apparatus according to the present invention comprises: a water heater which is connected with a water supply pipe and a hot water pipe such that wash water supplied from the water supply pipe is heated to a proper temperature by the water heater while proceeding to the hot water pipe through the water heater; a water supply controlling means for controlling supply of the wash water to the water heater; a discharge means for discharging to the human privates the wash water heated to the proper temperature by the water heater, which is connected with the hot water pipe; an air mixing means for mixing air into the wash water; and a controller for controlling so as to change, in response to control of the supply of the wash water by the water supply controlling means, amount of the air mixed into the wash water by the air mixing means.

In the human privates washing apparatus of the present invention, since the air mixing means is provided between the water heater and the discharge means, air bubbles are prevented from remaining in the water heater and becoming larger in diameter. Meanwhile, since the water heater is of instantaneous heating type, power consumption is lessened by reducing loss due to heat dissipation and amount of hot water by mixing of air thereinto.

Meanwhile, in order to eliminate the above described disadvantages of conventional water heaters for human privates washing apparatuses, the present invention provides a water heater for a human privates washing apparatus includes a flat platelike heating means, a water inlet, a hot water outlet and an internal flow path which is communicated with the water inlet and the hot water outlet, has at least one bent portion and is disposed in thermal contact with each of opposite faces of the heating means.

In the water heater for the human privates washing apparatus, according to the present invention, since flow velocity can be increased while heat transfer area is secured, heat transfer rate can be increased, so that the water heater can be made for higher load and more compact.

Furthermore, in order to solve the above described problems of known flow rate detecting means for human privates washing apparatuses, the present invention provides a flow rate detecting means for a human privates washing apparatus comprises: a rotor which includes a plurality of rotary vanes extending radially from its axis at regular angular intervals and having an identical shape; a housing which has a substantially cylindrical chamber for receiving the rotor; an inflow path which causes the wash water to flow into the chamber in a tangential direction of a rotational circle of the rotor; an outflow path which is provided at such a position that a streamline drawn by the wash water flowing into the chamber from the inflow path defines a substantially U-shaped locus along the rotational circle of the rotor; and a detection means for detecting the number of revolutions of the rotor.

In the flow rate detecting means for the human privates detecting apparatus, since large fluidal force is applied to the rotor during its rotations, stable output can be obtained even by quite minute flow rate and thus, value of detected flow rate is improved.

Meanwhile, in the flow rate detecting means for the human privates detecting apparatus, if the outflow path is formed inwardly of an outer periphery of the rotor and in parallel with the axis of the rotor, air bubbles adhering to the rotor are readily discharged from the outflow path without being collected in the vicinity of the axis of the rotor, so that rotational nonuniformity of the rotor and improper detection of the detection means for detecting the number of revolutions of the rotor are prevented, thereby resulting in improvement of accuracy of detection of flow rate.

These objects and features of the present invention will become clear from the following description taken in conjunction with the preferred embodiments thereof with reference to the accompanying drawings throughout which like parts are designated by like reference numerals.

DETAILED DESCRIPTION OF THE INVENTION

Hereinafter, preferred embodiments of the present invention are described with reference to the attached drawings. (First Embodiment)

Figure 1:
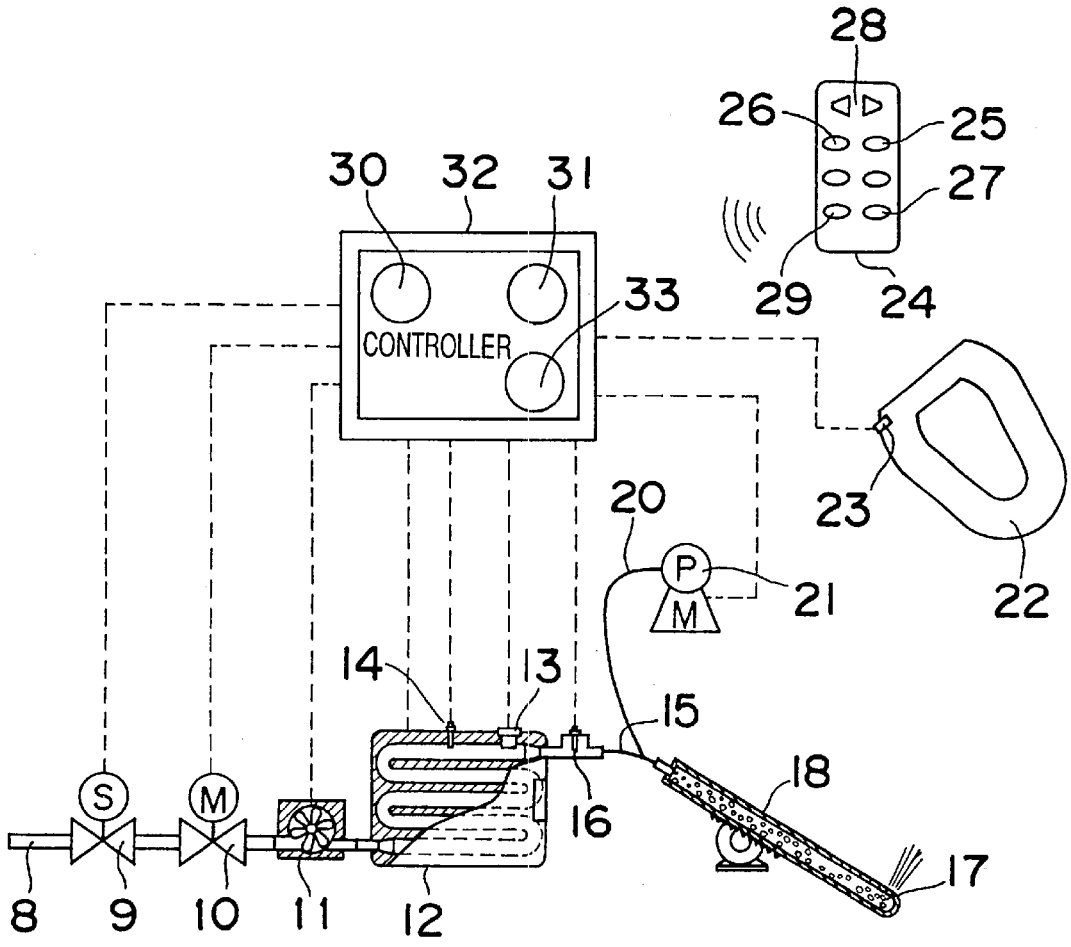
FIG. 1 is a system diagram of a human privates washing apparatus according to a first embodiment of the present invention.

FIG. 1 shows a human privates washing apparatus according to a first embodiment of the present invention. In FIG. 1, water supplied from a water supply pipe 8 proceeds to an instantaneous heating type water heater 12 (i.e., a heating means which is capable of continuously heating the water to a preset temperature during flow of the water as described earlier in "Background Art") through a main solenoid valve 9, a motor-driven flow control valve 10 for adjusting amount of wash water and a flow rate sensor 11 acting as a flow detecting means for detecting flow and flow rate of wash water. The main solenoid valve 9 and the flow control valve 10 each act as a water supply controlling means. The water heater 12 is provided with a high limit switch 13 for directly cutting off power supply to the water heater 12 upon detection of abnormal rise of temperature of the water heater 12 itself and an air detecting thermistor 14 for detecting presence or absence of water in the water heater 12. A hot water thermistor 16 for detecting temperature of hot water is provided on a hot water pipe 15 disposed adjacent to an outlet of the water heater 12. A washing nozzle unit 18 at a distal end of which a washing nozzle 17 acting as a discharge means is provided is connected with a distal end of the hot water pipe 15. Projection and retraction of the washing nozzle 17 are controlled by a motor. Between the washing nozzle 17 and the water heater 12, air is mixed into wash water through an air pipe 20 by a motor-driven air pump 21 acting as an air mixing means. Wash water fed from the washing nozzle 17 is used for washing privates of a user seated on a toilet seat 22. The toilet seat 22 is provided with a seating switch 23 for detecting seating of the user on the toilet seat 22.

A command for effecting feed of wash water from the washing nozzle 17 is issued from a remote control unit 24. The remote control unit 24 has an anal washing switch 25, a bidet washing switch 26 for washing female genitals, a stop switch 27 for stopping wash water, an adjustment portion 28 for adjusting flow rate and temperature of wash water and a changeover switch 29 for changing over adjustment of the adjustment portion 28 to flow rate or temperature of wash water. The anal washing switch 25 and the bidet washing switch 26 each act as a washing setting means and a selection means, while the stop switch 27 acts as the washing setting means and acts also as a flow rate detecting means for indirectly detecting stop of flow of wash water. Meanwhile, in FIG. 1, only the washing nozzle unit 18 for anal washing is illustrated and a washing nozzle unit for bidet washing having a similar arrangement is provided but is not illustrated.

Meanwhile, a controller 32 receives radio signals from the remote control unit 24 and controls the respective constituent elements connected with the controller 32 as shown by dot lines. The controller 32 has an air mixing ratio controller 30 for controlling mixing ratio of air to wash water and a flow rate controller 31 for effecting control on the basis of signals from flow rate sensor 11. The controller 32 is provided with a preheating switch 33 for selecting heating in the water heater 12 when water or hot water does not flow.

Figure 2:
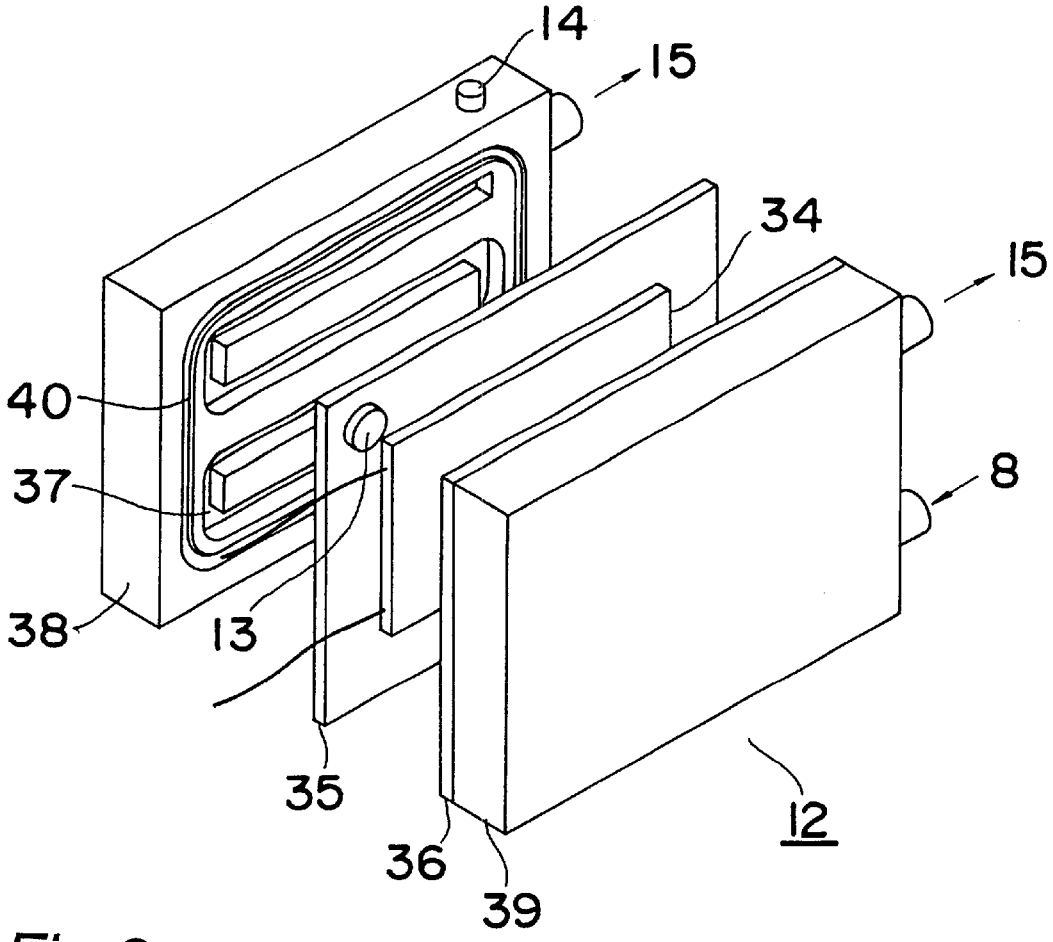
FIG. 2 is an exploded perspective view explanatory of a main arrangement of a water heater employed in the human privates washing apparatus of FIG. 1.

FIG. 2 shows details of the water heater 12. A ceramic heater 34 for performing heating electrically is gripped between copper plates 35 and 36 and resinous casings 38 and 39 each having an internal flow path are provided outside the copper plates 35 and 36. These casings 38 and 39 are pressed against the copper plates 35 and 36 by sealing mediums 40. Meanwhile, the high limit switch 13 is attached to a surface of the copper plate 35, while the air detecting thermistor 14 is fixed to an upper portion of the casing 38.

Figure 3:
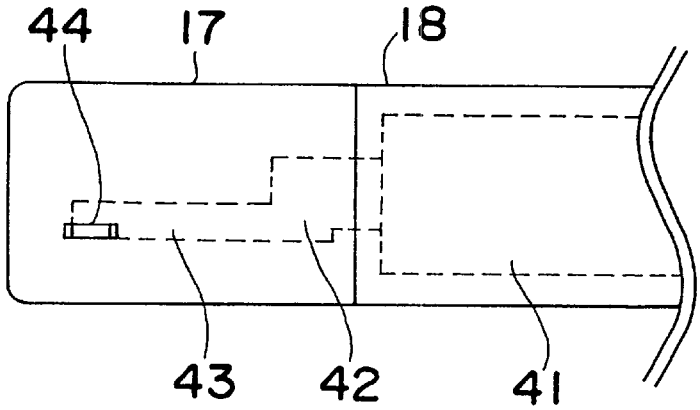
FIG. 3 is a top plan view of a washing nozzle employed in the human privates washing apparatus of FIG. 1.
Figure 4:
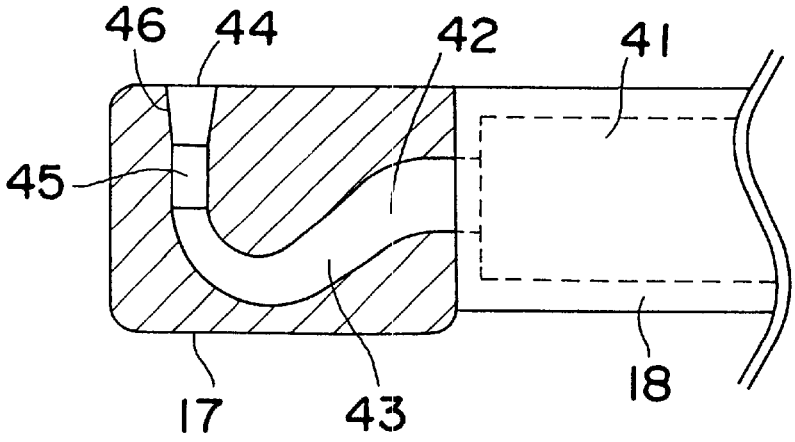
FIG. 4 is partial sectional side elevational view of the washing nozzle of FIG. 3.

FIGS. 3 and 4 show details of the washing nozzle 17. FIG. 3 is a top plan view showing the washing nozzle 17 observed from above and FIG. 4 is a partly sectional side elevational view of the washing nozzle 17. A flow path in the washing nozzle 17 is gradually reduced in cross-sectional area from a flow path 41 of the washing nozzle unit 18 to flow paths 42 and 43 in the washing nozzle 17 and then, extends via a parallel portion 45 to an enlarged portion 46 having a width increasing gradually towards a nozzle port 44. By this arrangement, when hot water having air mixed thereinto is fed, wash water is discharged to human privates while being swung in a comparatively wide range by a function of air mixing and a function of the enlarged portion 46. Namely, Coanda phenomenon in which when proceeding from the parallel portion 45 to the enlarged portion 46, hot water adheres to one of its opposed walls is disturbed by air mixed into the hot water at random, so that a jet is fed so as to be swung laterally. When mixing of air into hot water is stopped, hot water is rectilinearly discharged in a comparatively narrow range by a function of the parallel portion 45. By selecting whether or not air is mixed into hot water through utilization of this phenomenon, the washing jet can be fed through changeover between swing motion and rectilinear motion.

Figure 5:
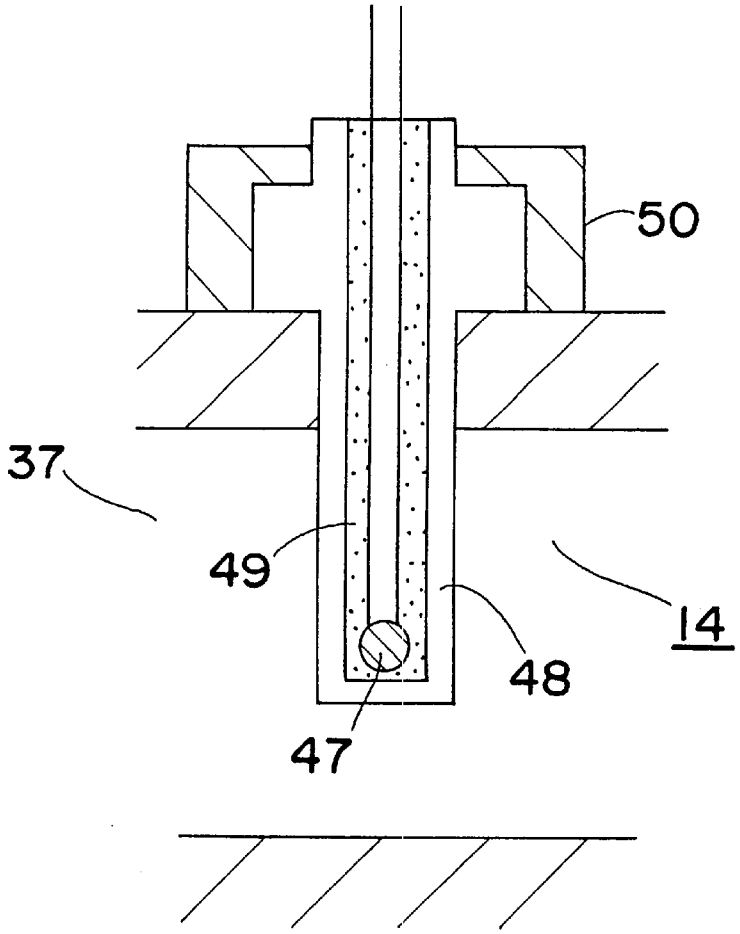
FIG. 5 is a fragmentary sectional view of an air detecting thermistor employed in the human privates washing apparatus of FIG. 1.

FIG. 5 shows details of the air detecting thermistor 14. A periphery of a bead 47 of the thermistor is protected by a protective pipe 48 and filler 49 is filled between the bead 47 and the protective pipe 48 so as to be packed. The protective pipe 48 is fixed by a clamp so as to project into a flow path of the hot water pipe 15. An air detecting principle in this air detecting thermistor 14 is as follows. Initially, after temperature has been measured preliminarily, electric power is supplied to the air detecting thermistor 14 itself so as to heat the air detecting thermistor 14. Upon lapse of a predetermined period, temperature is measured again and is compared with the temperature measured prior to heating. In case the air detecting thermistor 14 is surrounded by water (hot water), heat dissipation after heating is comparatively large and thus, temperature difference between prior to and after heating is small. If the air detecting thermistor 14 is surrounded by air, heat dissipation after heating is comparatively small and thus, temperature difference between prior to and after heating is large. On the basis of magnitude of this temperature difference, it is judged whether the air detecting thermistor 14 is surrounded by water (hot water) or air. In order to form an accurate judgement in a series of this control, heating period is set to be long and short when temperature prior to heating is high and low, respectively. Meanwhile, a decision as to whether the air detecting thermistor 14 is surrounded by water or air is made on the basis of difference between temperature prior to heating and temperature after heating so as to be less affected by ambient temperature.

Figure 6:
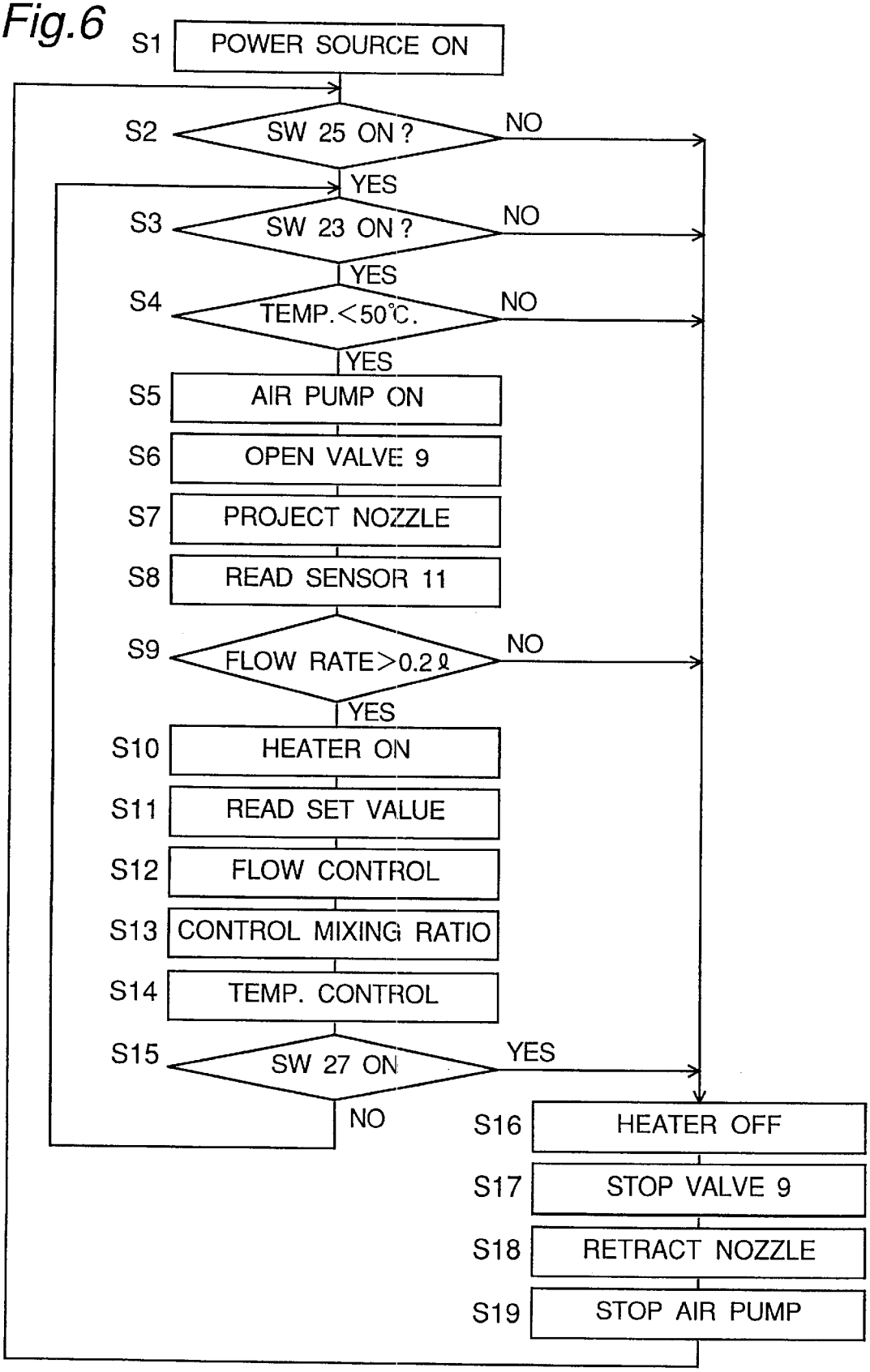
FIG. 6 is a flow chart showing control of operation of the human privates washing apparatus of FIG. 1.

Operation of the human privates washing apparatus of this embodiment is described with reference to FIG. 6. When a power source has been turned on at step S1 and the anal washing switch 25 has been operated at step S2, the program flow proceeds to step S4 of temperature decision of the hot water thermistor 16 if the seating switch is in ON state through seating of the toilet seat 22 by the user at step S3. The controller 32 judges that it is safe and dangerous when temperature detected by the hot water thermistor 16 is less than and not less than a predetermined temperature of 50° C., respectively. In case it is judged that it is dangerous, subsequent discharge of wash water to human privates is not performed. By this judgement, discharge of high-temperature hot water to the human privates from the washing nozzle 17 is prevented and thus, safety against any possible danger is ensured. Meanwhile, also during use, if temperature of hot water is not less than 50° C. due to failure of a temperature control system of the water heater 12 or sudden drop of amount of wash water, the hot water thermistor 16 detect this and immediately stops supply of hot water by the main solenoid valve 9. Subsequently, the air pump 21 is started at step S5, the main solenoid valve 9 is opened at step S6 and the washing nozzle 17 is gradually projected at step S7. The air pump 21 is started earlier in order to prevent back flow of water even if a check mechanism of the air pump 21 itself fails. By this function, it is possible to prevent deterioration of performance and failure due to back flow of water or hot water into the air pump at the time of start of use.

Then, after a while, value of the flow rate sensor 11 is read at step s8. If flow rate exceeds 0.2 l/min. at step S9, the controller 32 judges that there is flow of water, so that power supply to the water heater 12 is started such that wash water is heated by producing heat from the ceramic heater 34 at step S10. Thereafter, a flow rate value set at the remote control unit 24 is read at step S11 and the flow control valve 10 is controlled by comparing this set value with a value detected by the flow rate sensor 11 so as to obtain flow rate of the set value at step S12.

Figure 7:
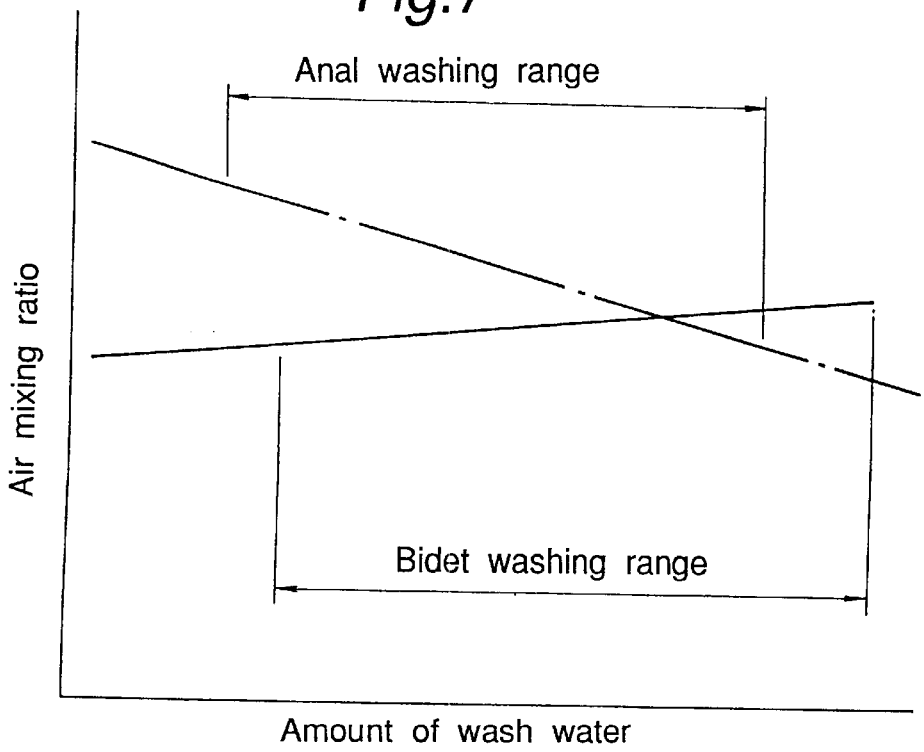
FIG. 7 is a graph showing the relation between the amount of wash water and air mixing ratio in the human privates washing apparatus of FIG. 1.

Then, voltage applied to the air pump 21 is controlled on the basis of the read value of the flow rate sensor 11 such that a ratio of amount of air mixed into wash water to a preset amount of wash water assumes a predetermined value at step S13. The number of revolutions of a motor of the air pump 21, hence, amount of air discharged from the air pump 21 changes according to voltage. Relation between amount of wash water and amount of air mixed thereinto is shown in FIG. 7. In the case of anal washing, air mixing ratio is increased as amount of wash water is reduced. If air mixing ratio is increased, diameter of air bubbles is apt to increase as amount of wash water is reduced, for the following reason. Namely, flow rate of wash water is restricted at its inlet by the flow control valve 10. Therefore, if flow rate of wash water is reduced, internal pressure of wash water at the washing nozzle 17 drops, so that diameter of air bubbles is likely to become larger even if the same amount of air as that for large amount of wash water is mixed into wash water.

Generally, if amount of air bubbles having large diameter is increased, stimulative bodily sensation is increased and washing capability is also upgraded. However, if amount of air bubbles is increased extremely, jet is inclined to become intermittent, which is disliked by many users. In view of this in anal washing, priority is given to washing capability and control is performed such that air mixing ratio is properly increased as amount of wash water is reduced. Meanwhile, in bidet washing, if air mixing ratio is raised, diameter of air bubbles increases, which gives disgustful bodily sensation to many users. In bidet washing, many users are inclined to estimate sensation that privates are wetted higher than washing effect of wash water itself. Therefore, in bidet washing, control is performed such that air mixing ratio is lessened as amount of wash water is reduced. At any rate, since amount of air mixed into wash water can be changed automatically in response to control of flow rate of wash water, the user need not perform a plurality of operations and need not be skilled in operational sequences or timings corresponding to situations, so that even the old or children can use the apparatus at will.

Thereafter, in order to obtain a desired temperature of wash water, the controller 32 compares a temperature set at the remote control unit 24 with a temperature of the hot water thermistor 16 so as to adjust quantity of heating of the water heater 12 at step S14. In case the set temperature of wash water is to be changed, the changeover switch 29 for effecting changeover between flow rate and temperature in the remote control unit 24 is changed over to temperature such that temperature is adjusted at the adjustment portion 28. Meanwhile, in case the set flow rate is to be changed, the changeover switch 29 is changed over to flow rate such that flow rate is adjusted at the adjustment portion 28. If the set flow rate is changed, amount of air mixed into wash water is changed in response to flow rate of wash water as described above. Accordingly, such malfunctions can be prevented that temperature of the ceramic heater 34 is raised abnormally due to back flow of air into the water heater 12 caused by extreme reduction of amount of. air and wash water flows backwardly into the air pump 21 due to lack of rotations of the air pump 21. Meanwhile, bodily sensation and washing capability can be made proper and the user can use the apparatus precisely without performing a plurality of operations.

Hot water which has been adjusted to the set flow rate by the flow control valve 10 and adjusted to the set temperature by the water heater 12 proceeds to the washing nozzle unit 18. At the washing nozzle unit 18, the hot water is mixed with air supplied through the air pipe 20 from the air pump 21 and then, is discharged to the human privates from the washing nozzle 17. In the case of washing of the human privates with hot water mixed with air, wash water is swung over a comparatively wide area of the human privates by function of the washing nozzle 17 so as to wash the human privates. In comparison with a conventional case in which washing is performed with only hot water, washing can be performed at a flow rate not more than a half of that of the conventional case without incurring deterioration of washing capability and the user's bodily sensation. This has been confirmed also experimentally.

Meanwhile, since the instantaneous heating type water heater 12 is employed, loss due to heat dissipation during storage of hot water in a conventional hot water storage type heating means is eliminated, so that power consumption may be about a half of that of the conventional heating means. By also the feature that the flow rate may be the half of that of the conventional case, power consumption can be reduced greatly. If a season having low temperature of supplied water is taken into consideration, an instantaneous heating type water heater generally requires a rated value of about 2.5 KW (25 A) and utilization of the water heater has been difficult due to the restriction that general plug receptacles for home use are limited to 15 A. However, in the present invention, since the water heater 12 may require only 1.2 KW, the general plug receptacles can be used. Meanwhile, since the air pump 21 for mixing air into hot water is provided between the water heater 12 and the washing nozzle 17, it becomes possible to prevent air from remaining in the water heater 12 and thus, local boiling and abnormal heating in the water heater 12 can be prevented.

Heating of wash water by the water heater 12 and mixing of air by the air pump 21 are continued until the stop switch 27 is operated at step S15. In case a stop command is issued by operating the stop switch 27, power supply to the water heater 12 is initially stopped so as to cut of f power supply to the ceramic heater 34 at step S16. In this stop operation, power supply to the ceramic heater 34 is cut off in accordance with the stop command of the stop switch 27 before the flow rate sensor 11 reaches not more than a predetermined stop value of 0.18 l/min., so that safety is ensured. Namely, at the time of start of flow, the controller 32 starts power supply by detecting that a signal from the flow rate sensor 11 has exceeded the predetermined value. Meanwhile, at the time of stop of flow, the controller 32 stops power supply by detecting that the stop switch 27 has been pushed. As a result, the controller 32 secures safety not only by starting power supply after water has positively flown into the ceramic heater 34 but by stopping power supply before flow of water stops. In this case, the stop switch 27 functions as an indirect flow rate detecting means. In addition, in comparison with a case in which power supply to the ceramic heater 34 is stopped in response to the signal from the flow rate sensor 11, the ceramic heater 34 can be stopped earlier and temperature rise due to late heating caused by residual heat can be lessened by also the effect that flow is stopped subsequently.

Subsequently, after late heating caused by residual heat has been prevented by causing water to flow through the water heater 12 for a predetermined period, the main solenoid valve 9 is stopped at step S17. Then, when the flow rate sensor 11 detects that supply of wash water to the washing nozzle unit 18 has been stopped and the washing nozzle unit 18 has lost washing capability, the washing nozzle 17 is retracted at step S18. After the main solenoid valve 9 has been stopped, the air pump 21 is operated for a predetermined period so as to discharge high-temperature hot water produced by late heating caused by residual heat and then, the air pump 21 is stopped at step S19. In case flow of water has been stopped during use due to delivery of water mixed with a large amount of air or suspension of water supply, the flow rate sensor 11 detects that flow rate has reached not more than 0.18 l/min., so that power supply to the ceramic heater 34 is terminated such that heating performed without water and abnormal rise of temperature are prevented. Meanwhile, in case temperature of hot water rises due to failure of the controller 32, the high limit switch 13 set at 60° C. functions to turn off a main power source of the normal closed type main solenoid valve 9 so as to close the main solenoid valve 9 such that supply of hot water is stopped.

In case the water heater 12 is preheated when supply of hot water is not being performed, presence or absence of air in the water heater 12 is initially detected by the air detecting thermistor 14. If the air detecting thermistor 14 is surrounded by air, power supply to the water heater 12 is not performed when water supply to the water heater 12 is not being performed. Meanwhile, also when the preheating switch 33 is not turned on, preheating of the water heater 12 by the ceramic heater 34 is not performed. Preheating is performed until temperature detected by the hot water thermistor 16 reaches the predetermined temperature of 40° C. such that rapid rise of temperature is effected at the time of reoperation.

Supply and stop of hot water upon push of the bidet washing switch 26 are performed in the same manner as those of anal washing referred to above and thus, the description is abbreviated. As described earlier, bidet washing is characterized in that air mixing ratio is controlled so as to be reduced as amount of wash water is reduced.

In this embodiment, the water heater 12 including the ceramic heater 34 is employed as an instantaneous heating type heating means by way of example. The heater may also be replaced by other electrical heating means such as a sheathed heater and a heater in which a ribbon heater is insulated by mica. Meanwhile, heat of combustion may be utilized instead of electrical heating.

Meanwhile, the hot water thermistor 16 provided in the vicinity of the outlet of the water heater 12 is recited as a temperature detecting means in the vicinity of the heating means by way of example. The temperature detecting means may be provided in an internal flow path of the water heater 12 or may be mounted on the copper plate 35 or 36. Meanwhile, in addition to the thermistor, any other temperature detecting means such as a thermocouple and a metallic resistor can be employed.

Meanwhile, the main solenoid valve 9 and the flow control valve 10 are employed as the water supply controlling means by way of example but an independently provided main solenoid valve, an independently provided flow control valve having a water stop function or a water pump may act as the water supply controlling means.

Meanwhile, the washing nozzle 17 in which hot water is swung upon mixing of air thereinto is employed as the discharge means by way of example but a type in which hot water is not swung or a shower for merely discharging hot water mixed with air may act as the discharge means.

Meanwhile, the air pump 21 is employed as the air mixing means but may be replaced by a compressor, a blower or compressed air feeders provided at a remote location in a concentrated manner.

Meanwhile, the flow rate sensor 11 for directly detecting flow rate is employed as the flow rate detecting means by way of example but may be replaced by an indirect flow rate detecting means which detects a signal on opening degree of a flow control valve or the number of revolutions of a water supply pump.

Meanwhile, the flow rate sensor 11 for directly detecting flow of water and the stop switch 27 for indirectly detecting flow of water are employed as the flow rate detecting means for detecting flow of water or hot water by way of example but other indirect flow rate detecting means such as a flow rate switch or a pressure switch may act as the flow rate detecting means.

The air detecting thermistor 14 is employed as an air detecting means by way of example but may be replaced by a method in which water level is detected by an electrode or a float, a method in which composition of air is detected and a method in which presence of air is detected optically.

The stop switch 27, the anal washing switch 25 and the bidet washing switch 26 provided on the remote control unit 24 are employed as the washing setting means by way of example but an on-off valve for directly opening and closing the flow path of the water supply pipe and the hot water pipe may act as the washing setting means.

Meanwhile, the anal washing switch 25 and the bidet washing switch 26 are employed as the selection means by way of example but the selection means may be arranged to enable arbitrary selection of air mixing ratio for an identical site of the privates in accordance with diseases or health conditions without selecting sites of the privates.

(Second Embodiment)

Figure 8:
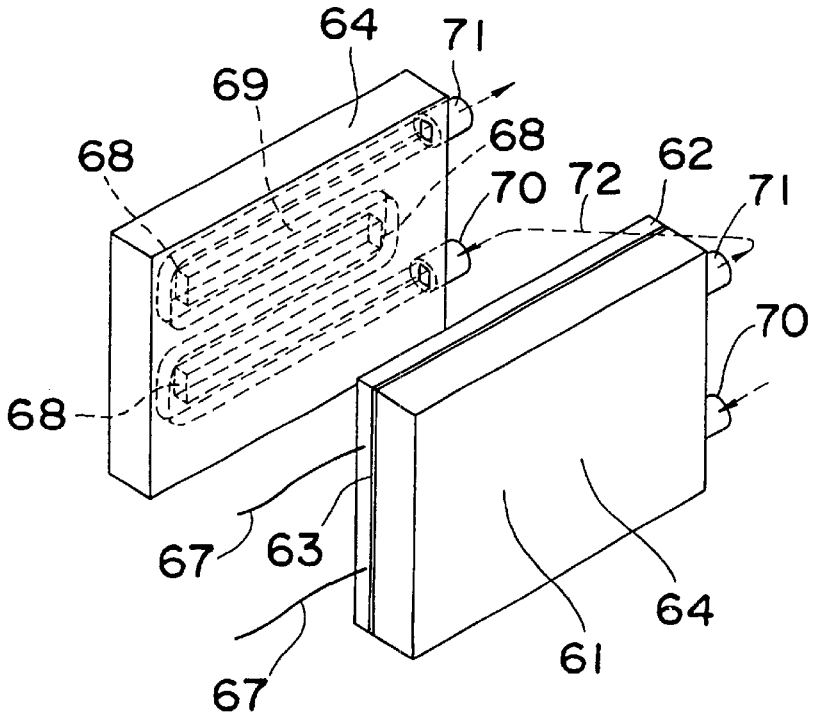
FIG. 8 is a schematic perspective view of a water heater employed in a human privates washing apparatus according to a second embodiment of the present invention.
Figure 9:
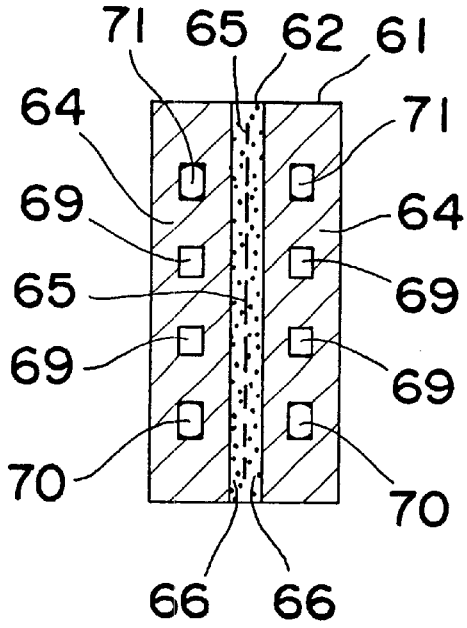
FIG. 9 is a transverse sectional view of the water heater of FIG. 8.
Figure 10:
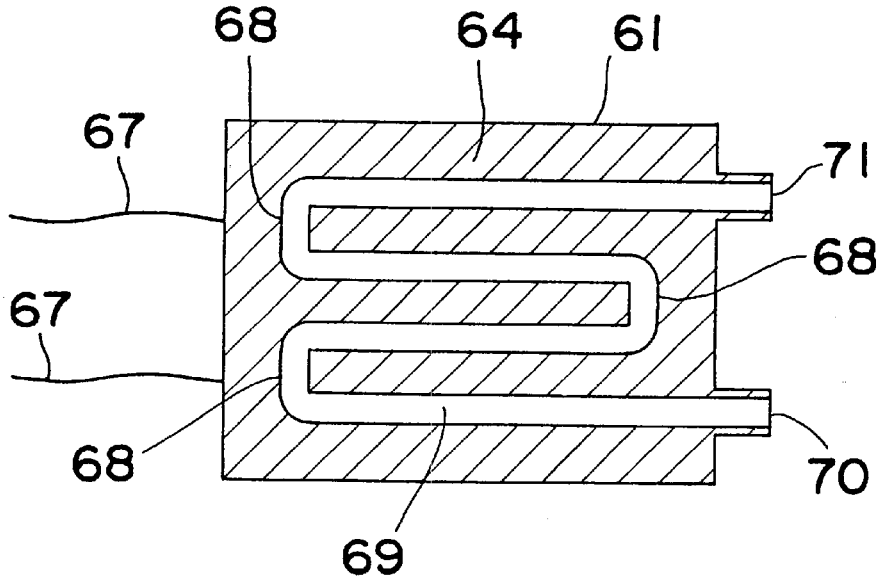
FIG. 10 is a longitudinal sectional view of the water heater of FIG. 8.

FIGS. 8, 9 and 10 are a schematic perspective view, a transverse sectional view and a longitudinal sectional view of a water heater employed in a human privates washing apparatus according to a second embodiment of the present invention, respectively. In FIGS. 8 to 10, a water heater body 61 is constituted by a ceramic heater 62 acting as a flat platelike heating means and provided at its substantially central portion and a pair of metallic heat exchange portions 64. Silicone agent 63 is applied to one face of the heat exchange portion 64 brought into contact with the ceramic heater 62 so as to improve heat conduction therebetween such that the ceramic heater 62 is gripped between the heat exchange portions 64. In the ceramic heater 62, a metallic heating element 65 which produces Joule's heat by supplying electric power thereto is gripped between a pair of rectangular ceramic plates 66 made of alumina or the like and then, is calcined integrally. Lead wires 67 are connected with opposite ends of the heating element 65. Meanwhile, in each of the heat exchange portions 64, a meandering water passage 69 having a plurality of bent portions 68 is formed in a substantially central cross section parallel to the ceramic heater 62 and is communicated with a water inlet 70 and a hot water outlet 71 opening to one end surface of each of the heat exchange portions 64. The hot water outlet 71 of one heat exchange portion 64 is connected with the water inlet 70 of the other heat exchange portion 64 by a pipe 72.

By the above described arrangement, when water is introduced into the water inlet 70 of the one heat exchange portion 64 and electric power is supplied to the ceramic heater 62 from the lead wires 67, heat produced by the heating element 65 is conducted to the heat exchange portions 64 through the ceramic plates 66 and the silicone agent 63 so as to be transferred to water having flowed into the water heater from the water inlet 70. Since the water is heated while flowing in series from the meandering water passage 69 of the one heat exchange portion 64 to the meandering water passage 69 of the other heat exchange portion 64 via the pipe 72, the water is turned into hot water in a short period during which the water passes through the water heater body 61, so that the hot water is discharged from the hot water outlet 71.

Therefore, since the water heater body 61 is an instantaneous heating type water heater in which water supplied continuously from the water inlet 70 is heated instantaneously, hot water having a fixed temperature can be discharged uninterruptedly for a long time. Meanwhile, since a wall of the meandering water passage 69 is a heat transfer surface, a large heat transfer area can be secured along a length of the wall and flow velocity can be increased by reducing cross-sectional area of the meandering water passage 69, so that its heat transfer rate can be increased. Thus, the water heater can be made for higher load and more compact in a simple construction at high thermal efficiency. Furthermore, since there is no water storage portion, thermal capacity of water is minute, so that temperature raise speed from start of use of the water heater to actual discharge of hot water having proper temperature is high and thus, control response is also improved in case a controller is provided so as to enable a user to change temperature or flow rate of hot water, etc.

Meanwhile, in this embodiment, the flat platelike ceramic heater is employed as the flat platelike heating means but may be modified variously, for example, a sheathed heater and a mica heater.

(Third Embodiment)

Figure 11:
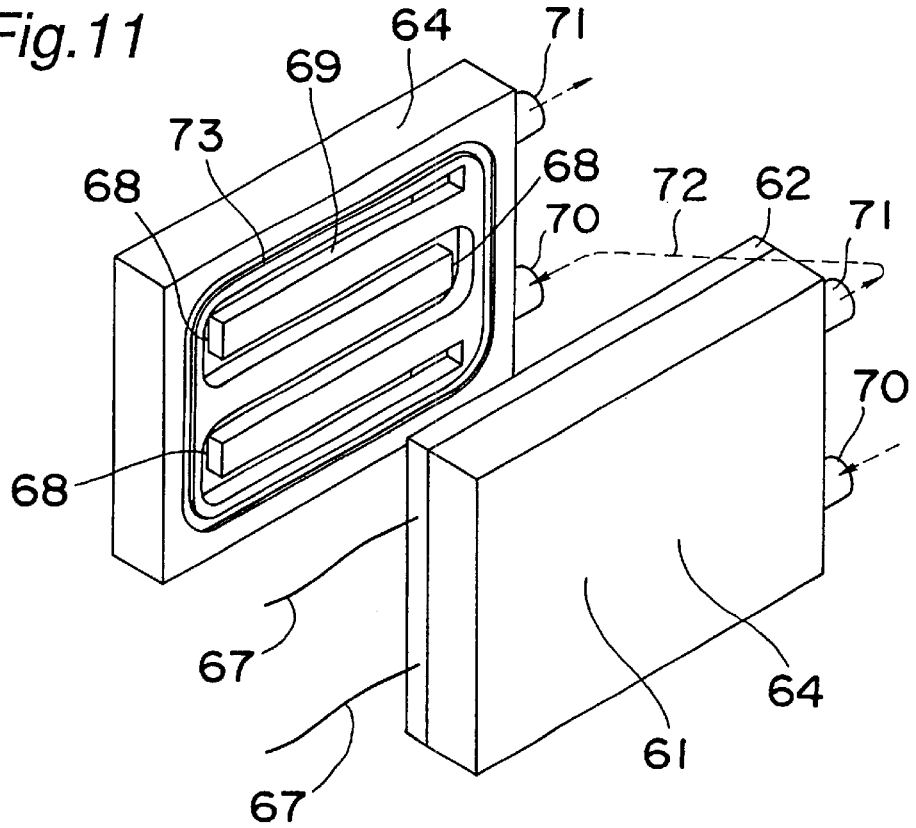
FIG. 11 is a schematic perspective view of a water heater employed in a human privates washing apparatus according to a third embodiment of the present invention.

FIG. 11 is a schematic perspective view of a water heater employed in a human privates washing apparatus according to a third embodiment of the present invention. Constituent elements having reference numerals identical with those of FIG. 8 to 10 correspond to the constituent elements of FIGS. 8 to 10 and therefore, the detailed description is abbreviated. In FIG. 11, a pair of the heat exchange portions 64 are made of resinous material and the meandering water passage 69 opens to one face of each of the heat exchange portions 64 adjacent to the ceramic heater 62 such that water comes into direct contact with the ceramic heater 62. An O-ring 73 is provided in each of the heat exchange portions 64 so as to close the meandering water passage 69 such that water does not leak from the meandering water passage 69.

By the above described arrangement, when water is introduced into the water inlet 70 and electric power is supplied to the ceramic heater 62, the ceramic heater 62 is formed by alumina which is an electrical insulator and has a large thermal conductivity, temperature raise speed of the heating means itself is high. As a result, since temperature raise and temperature control response of hot water can be performed in a moment and water having flowed into the water heater from the water inlet 70 is brought into direct contact with the ceramic heater 62 in the meandering water passage 69. Therefore, temperature raise speed and response can be further improved and thermal efficiency also can be raised. At this time, since water is electrically insulated from the heating element 65, the water heater can be operated without a risk of leak or short circuit.

(Fourth Embodiment)

Figure 12:
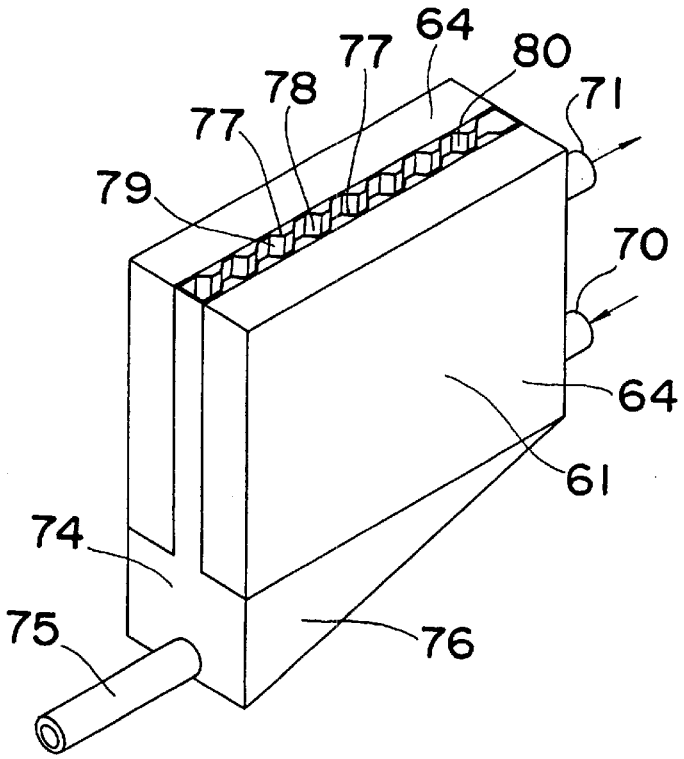
FIG. 12 is a schematic perspective view of a water heater employed in a human privates washing apparatus according to a fourth embodiment of the present invention.
Figure 13:
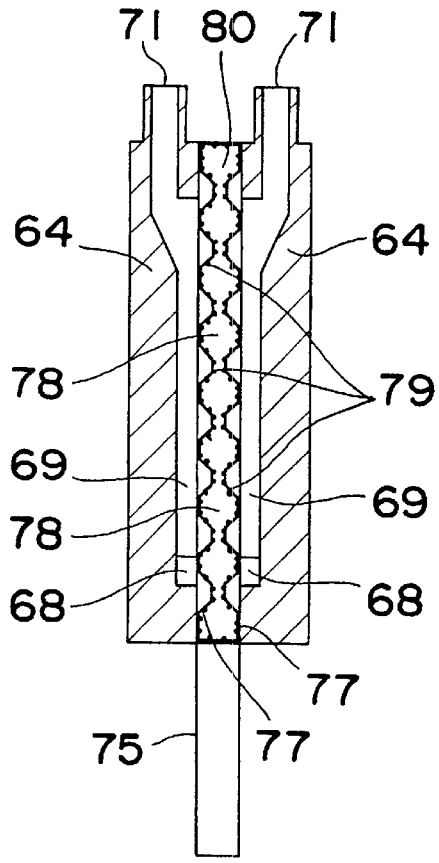
FIG. 13 is a horizontal sectional view of the water heater of FIG. 12.

FIGS. 12 and 13 are a schematic perspective view and a horizontal sectional view of a water heater employed in a human privates washing apparatus according to a fourth embodiment of the present invention, respectively. Constituent elements having reference numerals identical with those of FIGS. 8 to 11 correspond to the constituent elements of FIGS. 8 to 11 and therefore, the detailed description is abbreviated. In FIGS. 12 and 13, a catalytic combustion burner 74 is provided as a flat platelike heating means and is constituted by a fuel pipe 75 for supplying hydrocarbon fuel such as propane, butane and methanol, a volume portion 76 for causing uniform flow of the fuel supplied from the fuel pipe 75, a flat fuel passage 78 including two metal plates 77 bent like a corrugated plate and extending upwardly in platelike manner from the volume portion 76 disposed at a lower portion of the catalytic combustion burner 74, catalytic combustion portions 79 each formed by applying catalyst (not shown) to each of the metal plates 77 and an exhaust vent 80 for discharging exhaust combustion gas. A pair of the metallic heat exchange portions 64 are, respectively, bonded to opposite sides of the fuel passage 78 so as to readily transfer heat to the fuel passage 78 and thus, the water heater is obtained.

By the above described arrangement, fuel supplied from the fuel pipe 75 enters, via the volume portion 76, the fuel passage 78 gripped between a pair of the heat exchange portions 64. The fuel having entered the fuel passage 78 is brought into contact with the catalytic combustion portions 79 while passing through a gap between the metal plates 77 and produces heat through oxidation reaction with oxygen in air under action of the catalyst so as to be discharged, as exhaust combustion gas, from the exhaust vent 80. Heat produced at the catalytic combustion portion 79 at this time is conducted to the heat exchange portions 64 by way of the metal plates 77 and wall surfaces of the fuel passage 78 and is transferred to water introduced into the water heater from the water inlet 70 while the water is flowing through the meandering water passage 69 formed at the substantially central portion of each of the heat exchange portions 64, so that the water is turned into hot water having proper temperature such that the hot water is discharged from the hot water outlet 71. Consequently, it is possible to materialize an instantaneous heating type compact water heater having a simple construction, in which fuel such as hydrocarbon fuel is used. Meanwhile, since catalytic combustion is utilized, oxidation reaction progresses without reaching excessively high temperature, so that nitrogen oxides, etc. are not produced at high temperature and thus, the water heater emits clean exhaust gas.

(Fifth Embodiment)

Figure 14:
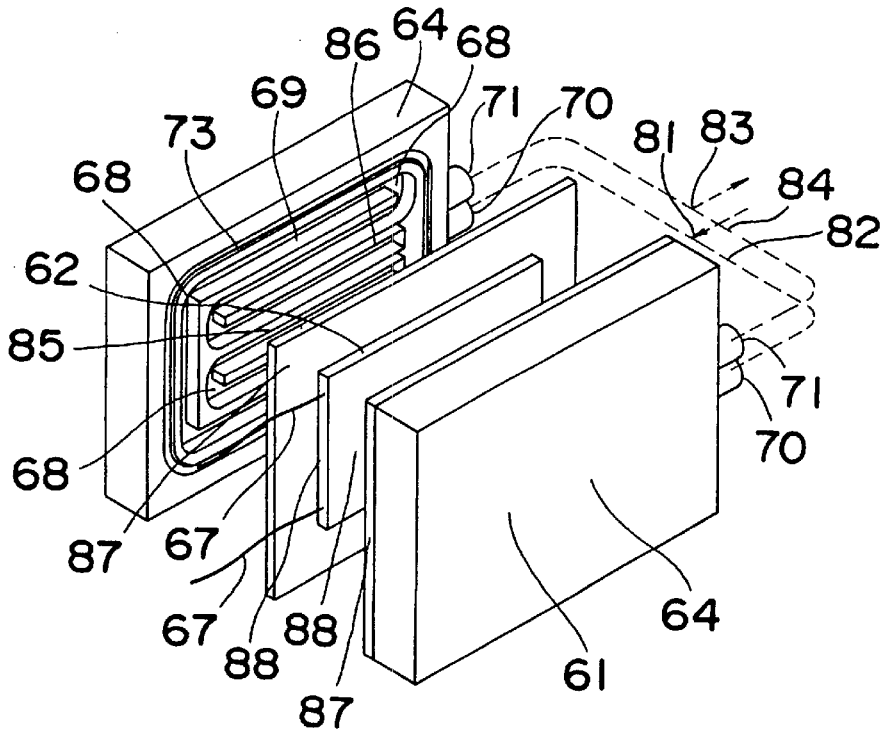
FIG. 14 is a schematic perspective view of a water heater employed in a human privates washing apparatus according to a fifth embodiment of the present invention.
Figure 15:
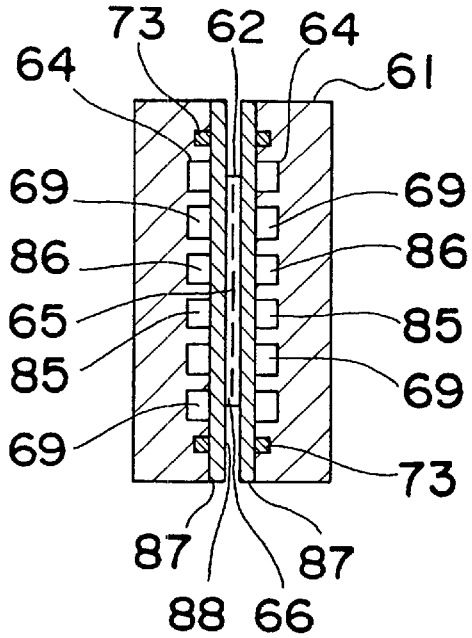
FIG. 15 is a transverse sectional view of the water heater of FIG. 14.
Figure 16:
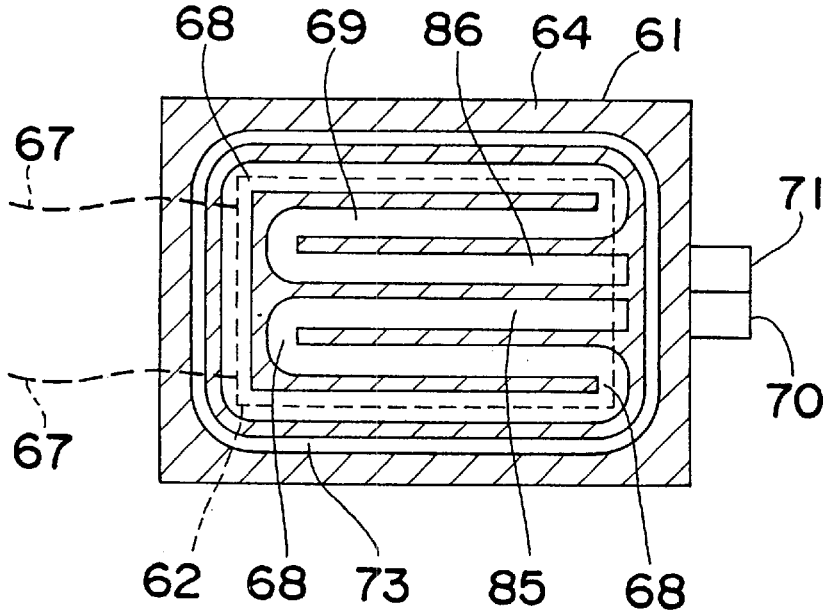
FIG. 16 is a longitudinal sectional view of the water heater of FIG. 14.

FIGS. 14, 15 and 16 are a schematic perspective view, a transverse sectional view and a longitudinal sectional view of a water heater employed in a human privates washing apparatus according to a fifth embodiment of the present invention, respectively. Constituent elements having reference numerals identical with those of FIGS. 8 to 13 correspond to the constituent elements of FIGS. 8 to 13 and therefore, the detailed description is abbreviated. In the drawings, a water supply source (not shown) and the respective water inlets 70 of a pair of the resinous heat exchange portions 64 are connected with a water supply pipe 82 having a branch portion 81, while the two hot water outlets 71 are connected with a hot water discharge pipe 84 having a confluent portion 83. In each of the heat exchange portions 64, the water inlet 70 and the hot water outlet 71 are provided adjacent to each other and the meandering water passage 69 communicating with the water inlet 70 and the hot water outlet 71 opens to one face of the heat exchange portion 64 adjacent to the ceramic heater 62, while an inflow path 85 close to the water inlet 70 and an outflow path 86 close to the hot water outlet 71 proceed next to and in parallel with each other and then, are connected with each other through the bent portions 68. A copper plate 87 acting as a heat transfer plate is integrally fixed to the heat exchange portion 64 through the O-ring 73 so as to close this open meandering water passage 69 such that leakage of water from the meandering water passage 69 does not occur. A pair of the heat exchange portions 87 each provided integrally with the copper plate 87 are brought into pressing contact, through a thin rubber sheet 88 having an excellent thermal conductivity, with the ceramic heater 62 smaller in area than the meandering water passage 69.

By the above described arrangement, water supplied to the water supply pipe 82 is caused to branch off from the branch portion 81 substantially equally so as to flow into the two water inlets 70. The water is heated to hot water by the ceramic heater 62 while passing through the inflow path 85 and a plurality of the bent portions 68. Since this hot water performs heat exchange with also water in the inflow path 85 lying next to the outflow path 86 of the meandering water passage 69, low-temperature water having entered the meandering water passage 69 is heated rapidly and thus, temperature difference in the meandering water passage 69 is lessened. The copper plate 87 having a large thermal conductivity further reduces this lessened temperature difference in the meandering water passage 69 through diffusion of heat a cross-sectional direction of the copper plate 87. As a result, since distribution of temperature on surfaces of the ceramic heater 62 becomes uniform, fracture of the ceramic heater 62 due to thermal strain can be prevented. Even when the heating element 65 acting as a heating portion of the ceramic heater 62 is formed up to an edge of the ceramic heater 62, the meandering water passage 69 is formed in an area larger than that of the heating element 65 so as to cover the ceramic heater 62. Therefore, since heat flow is transmitted to the constituent elements of the water heater such as the heat exchange portions 64 without being absorbed by water, it is possible to prevent an end portion, etc. of the water heater from partially reaching abnormally high temperature, thereby resulting in improvement of thermal efficiency and safety. In addition, since supplied water is caused to branch off from the branch portion 81 of the water supply water can be fed to a pair of the heat exchange portions 64 substantially equally, so that thermal conditions of opposite faces of the ceramic heater 62 become identical with each other. Hence, since temperature gradient is not produced between the opposite faces of the ceramic heater 62, fracture of the ceramic heater 62 due to thermal strain can be prevented, thus resulting in improvement of reliability. Meanwhile, in case the catalytic combustion burner 74 made of metal is employed as the flat platelike heating means as shown in FIG. 12, the heating means is subjected to warpage due to thermal strain, which also can be prevented in this embodiment.

(Sixth Embodiment)

Figure 17:
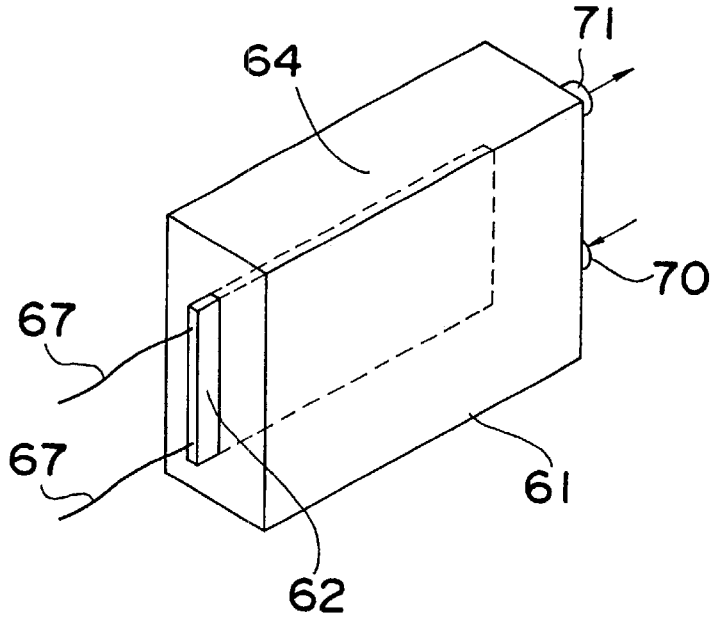
FIG. 17 is a schematic perspective view of a water heater employed in a human privates washing apparatus according to a sixth embodiment of the present invention.
Figure 18:
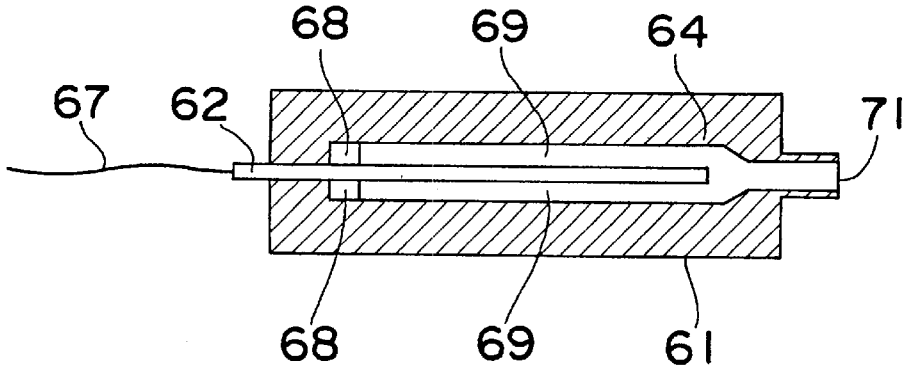
FIG. 18 is a horizontal sectional view of the water heater of FIG. 17.
Figure 19:
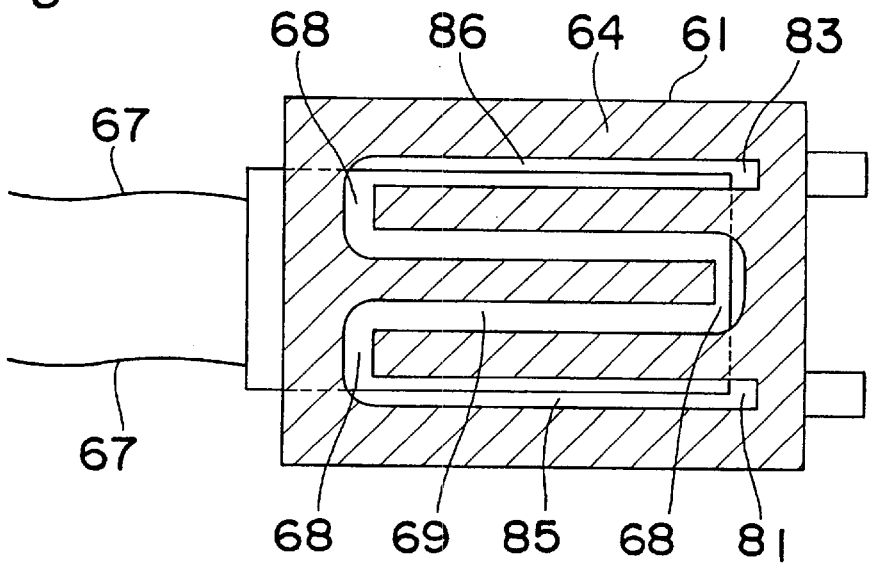
FIG. 19 is a vertical sectional view of the water heater of FIG. 17.

FIGS. 17, 18 and 19 are a schematic perspective view, a horizontal sectional view and a vertical sectional view of a water heater employed in a human privates washing apparatus according to a sixth embodiment of the present invention, respectively. Constituent elements having reference numerals identical with those of FIGS. 8 to 16 correspond to the constituent elements of FIGS. 8 to 16 and therefore, the detailed description is abbreviated. In the drawings, the water heater body 61 is constituted by one resinous heat exchange portion 64 having one water inlet 70 and one hot water outlet 71 and the ceramic heater 62 acting as a flat platelike heating means. The ceramic heater 62 is inserted into a substantial center of the heat exchange portion 64 in watertightness such that only one end portion of the ceramic heater 62 having the lead wires 67 is projected from the heat exchange portion 64.

In the heat exchange portion 64, there are provided the inflow path 85 extending along one side of the ceramic heater 62 from the water inlet 70, the branch portion 81 for effecting branching of the water passage to opposite faces of the ceramic heater 64, which is provided downstream of the inflow path 85, a pair of the meandering water passages 69 which are disposed at the opposite faces of the ceramic heater 62 and open to the ceramic heater 62 so as to bring water into direct contact with the ceramic heater 62, the confluent portion 83 for causing confluence of the two meandering water passages 69 at their terminal ends and the outflow path 86 for guiding hot water from the confluent portion 83 to the hot water outlet 71, which is provided at the other side of the ceramic heater 62 opposite to the in flow path 85. Meanwhile, the water heater body 61 is fixed such that the ceramic heater 62 stands substantially vertically. The water inlet 70 is disposed at a lowermost location of the ceramic heater 62, while the inflow path 85, the branch portion 81, the meandering water passage 69, the confluent portion 83 and the outflow path 86 are disposed gradually more upwardly in an upstream direction in this sequence and thus, the hot water outlet 71 is disposed at an uppermost location of the ceramic heater 62. The meandering water passage 69 is also arranged to prevent downstream side of the meandering water passage 69 from flowing downwardly.

By the above described arrangement, since the ceramic heater 62 having a high temperature raise speed and made of alumina which is an electrical insulator and has a large thermal conductivity transfers heat to water while being in direct contact with water, temperature raise and temperature control response of hot water can be performed in a moment and thermal efficiency can be improved. Meanwhile, since water flow is directed sequentially upwardly from the water inlet 70 to the hot water outlet 71 via the meandering water passage 69, air bubbles produced by separation of dissolved oxygen, etc. due to rise of water temperature are carried to the hot water outlet 71 by buoyancy so as to be discharged therefrom. Therefore, since turbulence due to air bubbles is not produced in flow of discharged hot water, the water heater can be operated safely by maintaining steady discharge of hot water. Moreover, it is. possible to prevent drop of heat transfer rate and thermal efficiency due to air bubbles in the heat exchange portion 64. Furthermore, since such a phenomenon is eliminated that air bubbles formed integrally to larger diameter remain at a spot in the meandering water passage 69 so as to cause local heat shock upon sudden drop of heat transfer rate at the spot, excessive reduction of service life of the ceramic heater 62 due to its fracture, etc. is prevented and thus, reliability of the flat platelike heating means can be improved. In addition, since water is caused to flow in parallel along the opposite faces of the ceramic heater 62, temperature gradient is not produced between the opposite faces of the ceramic heater 62, so that fracture of the ceramic heater 62 due to thermal strain can be prevented and thus, reliability of the flat platelike heating means can be improved.

(Seventh Embodiment)

Figure 20:
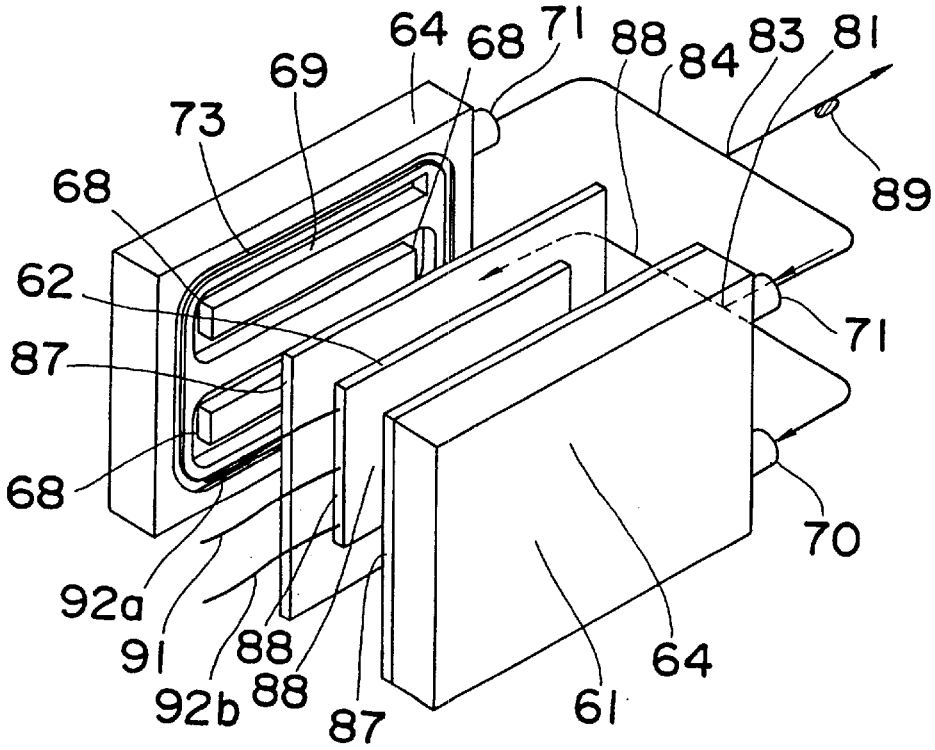
FIG. 20 is a schematic perspective view of a water heater employed in a human privates washing apparatus according to a seventh embodiment of the present invention.
Figure 21:
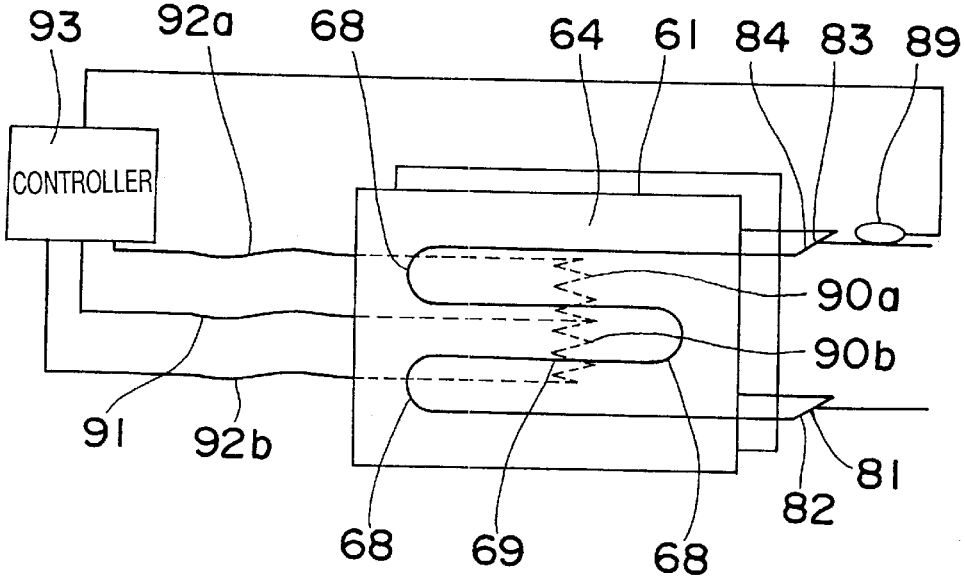
FIG. 21 is a schematic view showing an arrangement of the water heater of FIG. 20.

FIG. 20 and 21 are a schematic perspective view and a schematic view of a water heater employed in a human privates washing apparatus according to a seventh embodiment of the present invention. Constituent elements having reference numerals identical with those of FIGS. 8 to 19 correspond to the constituent elements of FIGS. 8 to 19 and therefore, the detailed description is abbreviated. In the drawings, a water supply source (not shown) and the respective water inlets 70 of a pair of the resinous heat exchange portions 64 are connected with the water supply pipe 82 having the branch portion 81, while the two hot water outlets 71 are connected with the hot water discharge pipe 84 having the confluent portion 83. A thermistor 89 for detecting temperature of discharged hot water is provided at a portion of the hot water discharge pipe 84 downstream of the confluent portion 83. The water heater body 61 is fixed such that the ceramic heater 62 stands substantially vertically. Since the meandering water passage 69 communicating with the water inlet 70 and the hot water outlet 71 of each of the heat exchange portions 64 is formed so as to be directed sequentially upwardly from the water inlet 70 to the hot water outlet 71, the water inlet 70 is provided at a substantially lowermost location of the water heater body 61, while the hot water outlet 71 is disposed at a substantially uppermost location of the water heater body 61. As a heating element in the ceramic heater 62, heating elements 90*a* and 90*b* are formed by two circuits of electric heaters having a substantially identical wattage and provided in parallel. One end of each of the two circuits is connected to a common lead wire 91. Meanwhile, the other end of one of the two circuits is connected to a lead wire 92*a,* while the other end of the other of the two circuits is connected to a lead wire 92b. The common lead wire 91 and the lead wires 92*a* and 92*b* are connected to a controller 93 for controlling ratios of electric power supplied to the heating elements 90*a* and 90*b,* respectively.

By the above described arrangement, the meandering water passage 69 extending sequentially upwardly from the water inlet 70 to the hot water outlet 71 is provided. Therefore, even if air bubbles are produced, the air bubbles are carried to the hot water outlet 7l so as to be discharged therefrom. Accordingly, not only the water heater can be operated safely by maintaining. steady discharge of hot water but it is possible to prevent drop of heat transfer rate and thermal efficiency due to air bubbles in the heat exchange portion 64. Meanwhile, since local heat shock due to air bubbles formed integrally to larger diameter is eliminated, fracture of the ceramic heater 62 is prevented and thus, reliability of the flat platelike heating means can be improved. Furthermore, since water is fed in parallel along the opposite faces of the ceramic heater 62, fracture of the ceramic heater 62 due to thermal strain is prevented and thus, reliability of the flat platelike heating means can be improved. Moreover, since the heating elements 90*a* and 90*b* are formed by the two circuits of the electric heaters having the identical wattage and provided in parallel, wattage of the electric heater of one circuit is reduced relative to a required total wattage at a rate of an inverse number of the number of circuits. As a result, since ratio of electric power supplied to each circuit having a small wattage is controlled, control resolution is remarkably improved and elaborate temperature control can be performed and heat shock can be lessened, so that service life of the electric heater is lengthened, thus resulting in improvement of its reliability. Meanwhile, in the case of cycle control method in which the number of cycles is adjusted in a control period of a predetermined duration and ratios of electric power supplied to the electric heaters is controlled by repeating the control period, each electric heater having a small wattage may be turned on and off cyclically, so that variations of voltage of a power source line can be restricted small. As a result, flicker of illumination, etc. can be prevented and temperature variations uncomfortable for an user of the water heater can be restrained.

Meanwhile, in this embodiment, the electric heaters having an identical wattage are provided in two circuits. However, if the number of the circuits is increased further, control resolution is further improved and thus, similar effects can be gained. Meanwhile, even if the electric heaters do not have a substantially identical wattage, similar effects can be apparently achieved by a control method.

(Eighth Embodiment)

Figure 22:
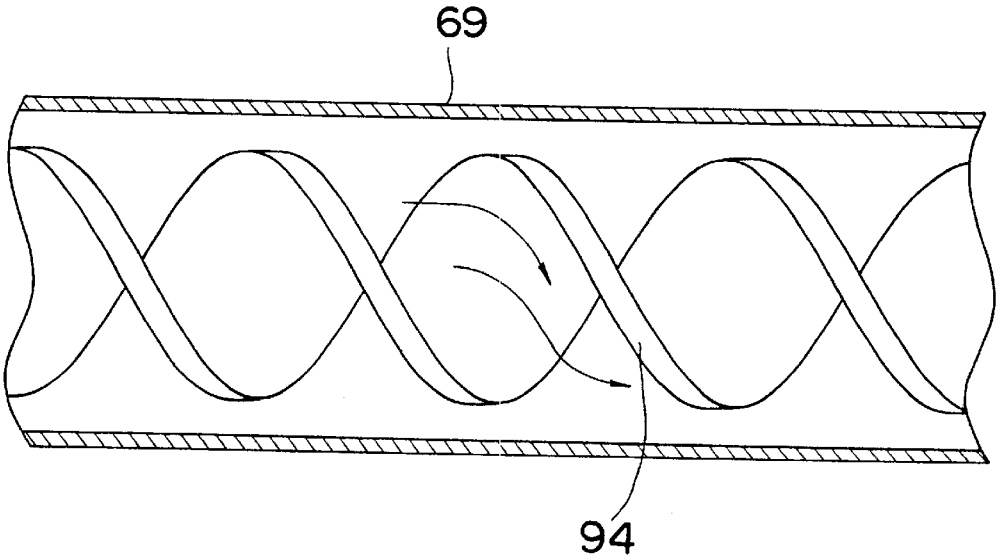
FIG. 22 is an enlarged fragmentary sectional view of a water heater employed in a human privates washing apparatus according to an eighth embodiment of the present invention.

FIG. 22 is an enlarged fragmentary sectional view of a water heater employed in a water heater according to an eighth embodiment of the present invention. In FIG. 22, the meandering water passage 69 has a rectangular cross section and a twisted plate 94 acting as a turbulent flow generator is inserted into the meandering water passage 69. In the above described arrangement, main flow of water flowing in the meandering water passage 69 is turned by action of the twisted plate 94, so that heat transfer rate from a wall surface of the meandering water passage 69 to water is improved. Hence, since heat transfer area can be reduced, the water heater can be made for higher load and more compact.

(Ninth Embodiment)

Figure 23:
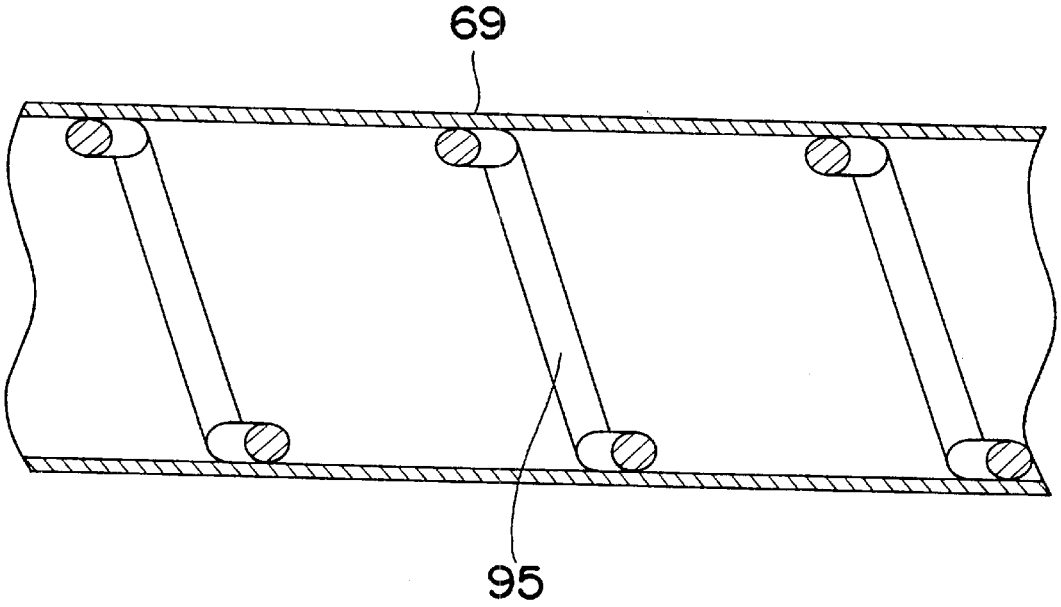
FIG. 23 is an enlarged fragmentary sectional view of a water heater employed in a human privates washing apparatus according to a ninth embodiment of the present invention.

FIG. 23 is an enlarged fragmentary sectional view of a water heater employed in a human privates washing apparatus according to a ninth embodiment of the present invention. In FIG. 23, the meandering water passage 69 has a rectangular cross section and a coiled wire 95 wound in a rectangular form and acting as a turbulent flow generator is inserted into the meandering water passage 69.

In the above described arrangement, flow of water flowing in the meandering water passage 69 is agitated in the vicinity of a heat transfer surface by action of the wire 95, so that heat transfer rate from a wall surface of the meandering water passage 69 to water is improved. Therefore, since heat transfer area can be reduced, the water heater can be made for higher load and more compact.

Meanwhile, in the eighth and ninth embodiments, the twisted plate 94 and the wire 95 are employed as the turbulent flow generators but may be replaced by a rectangular, trapezoidal, saw-toothed or triangular projection which is provided on the heat transfer surface so as to agitate flow in the vicinity of the heat transfer surface, a spiral vane for turning main flow or circular plates or rings which are arranged at regular intervals on a conduit so as to agitate main flow.

(Tenth Embodiment)

Figure 25:
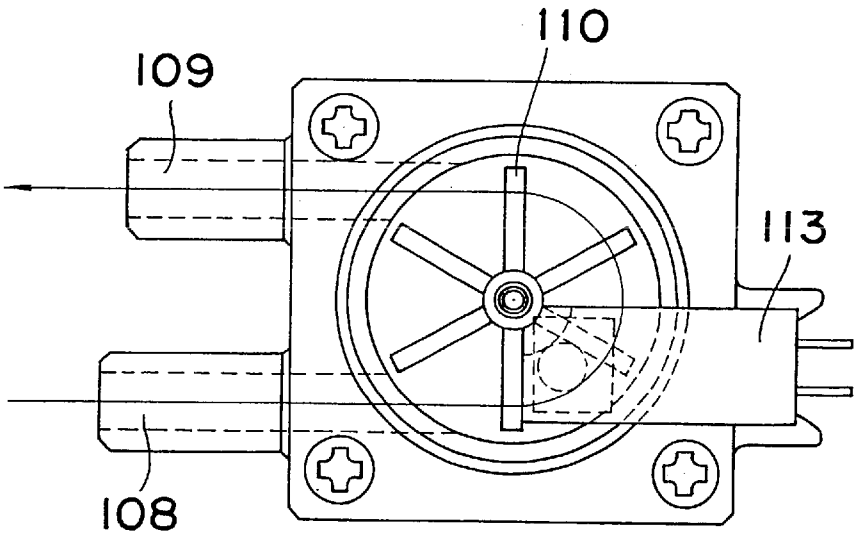
FIG. 25 is a front elevational view of the flow rate sensor of FIG. 24.
Figure 24:
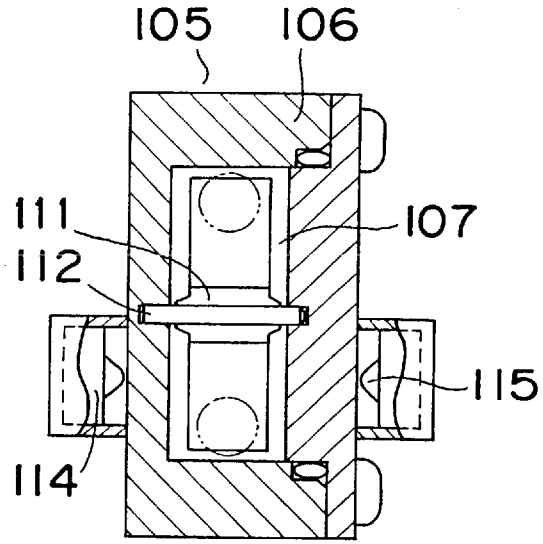
FIG. 24 is a sectional view of a flow rate sensor employed in a human privates washing apparatus according to a tenth embodiment of the present invention.

FIGS. 24 and 25 are a sectional view and a front elevational view of a flow rate sensor 105 employed in a human privates washing apparatus according to a tenth embodiment of the present invention, respectively. In FIGS. 24 and 25, a housing 106 is made of transparent material and has therein a substantially cylindrical chamber 107 connected with an inflow path 108 and an outflow path 109. In the chamber 107, a rotor 111 having six rotary vanes 110 extending radially from its axis at regular angular intervals and having an identical shape is rotatably supported by a shaft 112 provided substantially at a cylindrical center of the chamber 107 and is arranged to be rotated by fluidal force exerted by fluid having entered from the inflow path 108. Meanwhile, the inflow path 108 is parallel to a tangent of a rotational circle defined by the rotor 111 and is disposed at a location spaced a predetermined distance from an outer periphery of the rotary circle towards the shaft 112. The outflow path 109 opens to such a position that fluid entering from the inflow path 108 draws a substantially U-shaped streamline as shown by the arrow in FIG. 25. Meanwhile, a photo interrupter 113 acting as a means for detecting the number of revolutions is provided on the housing 106. In the photo interrupter 113, a light emitting diode 114 acting as a light emitting element and a photo diode 115 acting as a photosensor confront each other so as to have an optical axis parallel to the shaft 112.

Operation of the flow rate sensor 105 of the above described arrangement is described. Initially, fluid entering from the inflow path 108 is curved along the shape of the chamber 107 and flows by drawing the substantially U-shaped streamline as shown by the arrow in FIG. 25 so as to be discharged from the outflow path 109. Since the rotor 111 having the six rotary vanes 110 is rotatably supported by the shaft 112 in the chamber 107 at this time, fluid exerts fluidal force on the rotary vanes 110 so as to counterclockwise rotate the rotor 111 about the shaft 112 in FIG. 25. Since fluid exerts fluidal force on a plurality of the rotary vanes 110 at all times even if rotational angular position of the rotor 111 changes, scatter of rotational force applied to the rotor 111 as a whole is reduced and thus, the rotor 111 is rotated stably at all times. Meanwhile, since a plurality of the rotary vanes 110 are subjected to fluidal force, rotational force is increased and thus, the rotor 111 can be rotated even at a minute flow rate.

Meanwhile, light irradiated from the light emitting diode 114 is transmitted through the transparent housing 106 and reaches the photo diode 115 provided at an opposed position. At the time the rotary vanes 110 pass across the optical axis, light is intercepted by a thickness of each of the rotary vanes 110 in a tangential direction of the rotational circle of the rotor 111, so that output of the photo diode 115 changes and thus, the number of revolutions of the rotor 111 is detected by counting these output changes. Meanwhile, since the six votary vanes 110 are provided, six output changes of the photo diode 115 are counted during one rotation of the rotor 111, so that minute changes of flow rate, etc. can be detected positively and thus, accuracy of detection of flow rate is improved greatly.

By the arrangement of this embodiment, since fluid entering from the inflow path 108 is discharged from the outflow path 108 via the rotational circle of the rotor 111 so as to draw the substantially U-shaped streamline, the rotor 111 is subjected to large fluidal force. Therefore, since the rotor 111 is rotated even at a minute flow rate and is rotated uniformly and stably, minute flow rate can be detected highly accurately. Meanwhile, since a center of gravity of the rotor 111 coincides with the shaft 112, scatter of rotational force of the rotor 111 according to rotational angular position of the rotor 111 is reduced, so that the rotor 111 is rotated smoothly and positively and thus, minute flow rate can be detected highly accurately. Furthermore, since the rotor 111 has a quite simple construction, resistance to rotation of the rotor 111 is small and adhesion of air bubbles thereto can be prevented. In addition, even if air bubbles adhere to the rotor 111, the air bubbles can be readily separated therefrom. As a result, the rotor 111 can be rotated smoothly and positively.

(Eleventh Embodiment)

Figure 27:
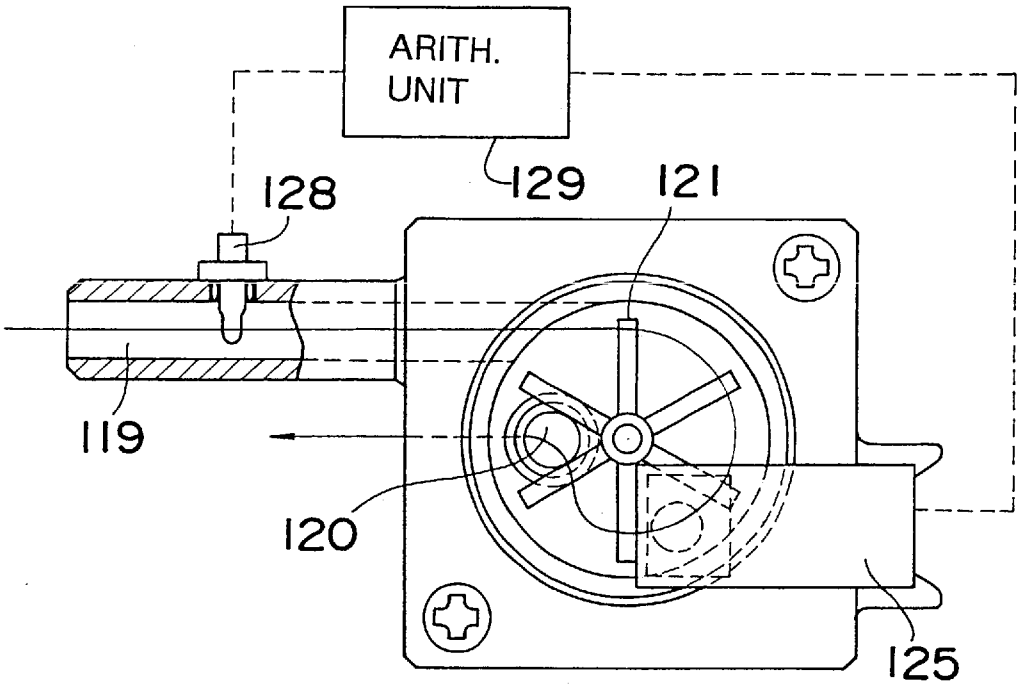
FIG. 27 is a front elevational view of the flow rate sensor of FIG. 26.
Figure 26:
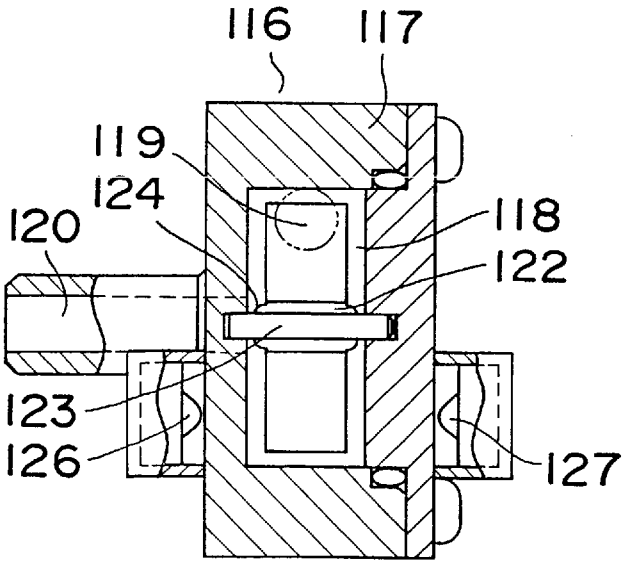
FIG. 26 is a sectional view of a flow rate sensor employed in a human privates washing apparatus according to an eleventh embodiment of the present invention.
Figure 28:
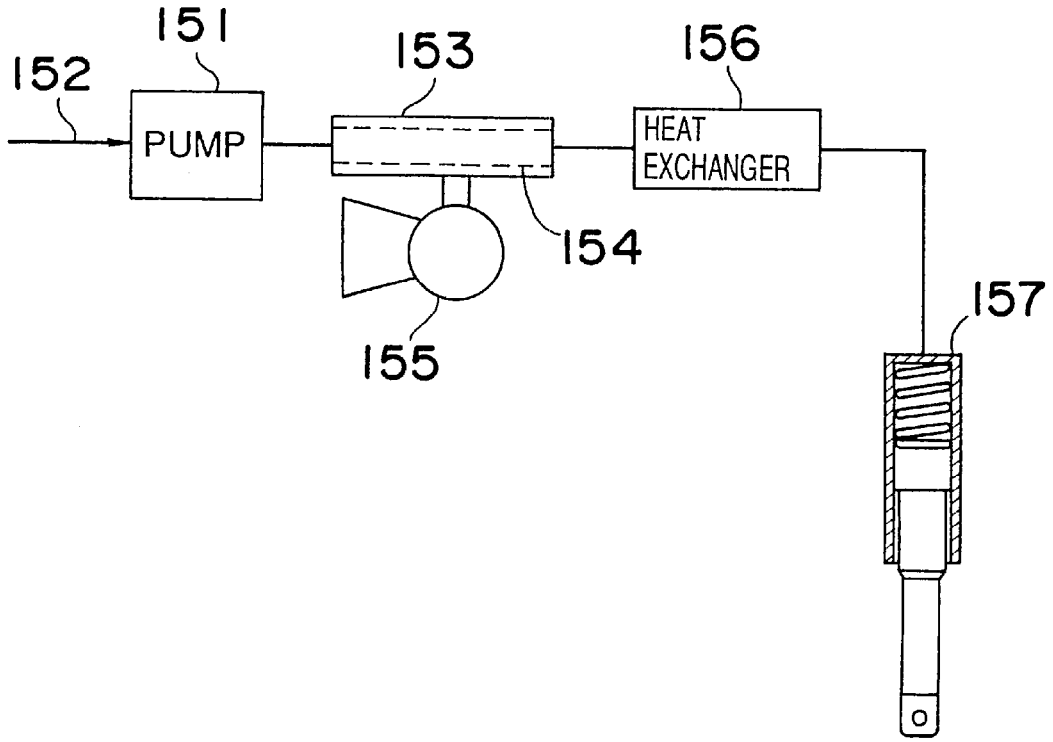
Fig.28 PRIOR ART
FIG. 28 is a system diagram of a prior art human privates washing apparatus.
Figure 29:
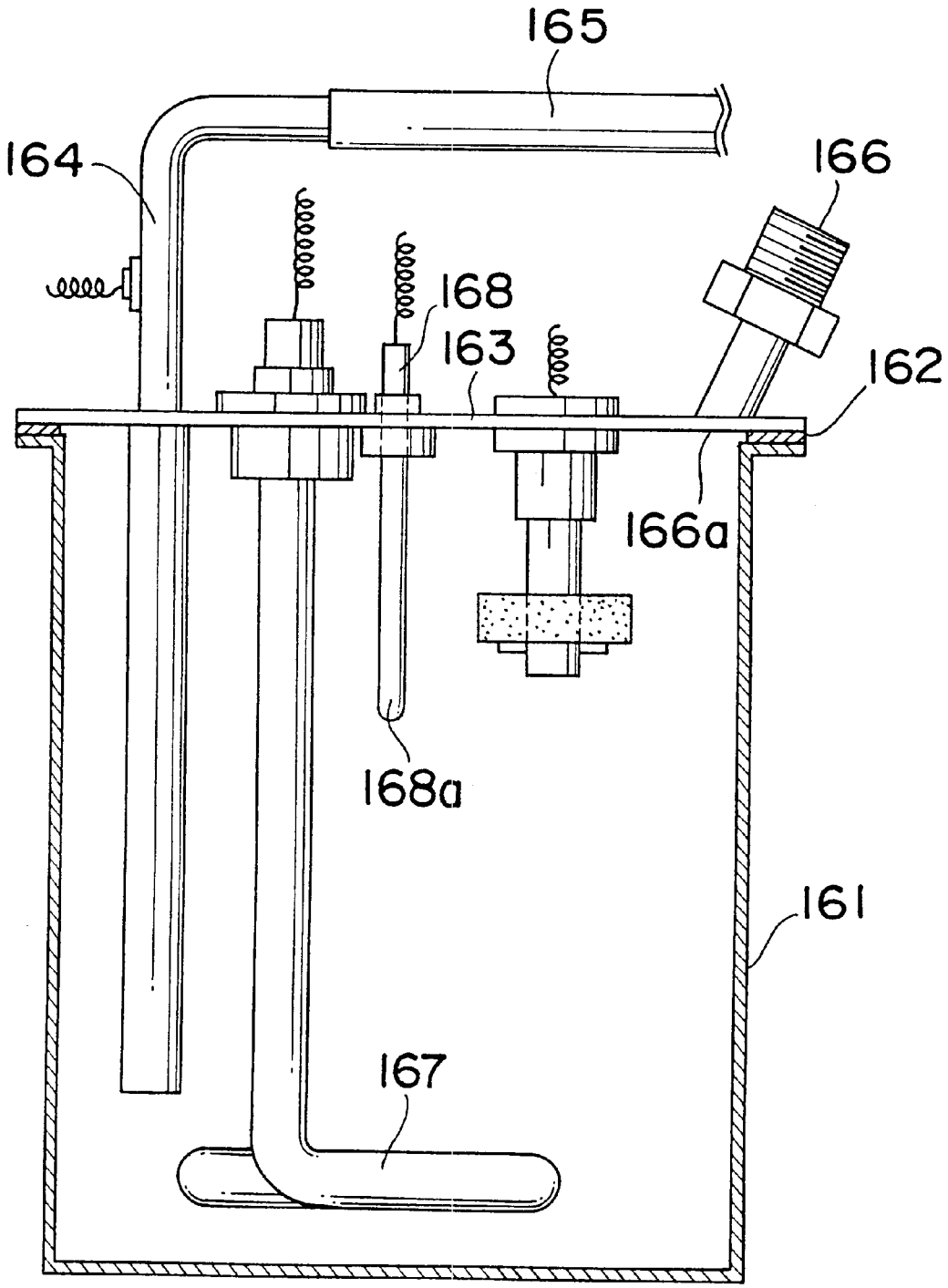
Fig.29 PRIOR ART
FIG. 29 is a schematic sectional view of a further prior art human privates washing apparatus.
Figure 30:
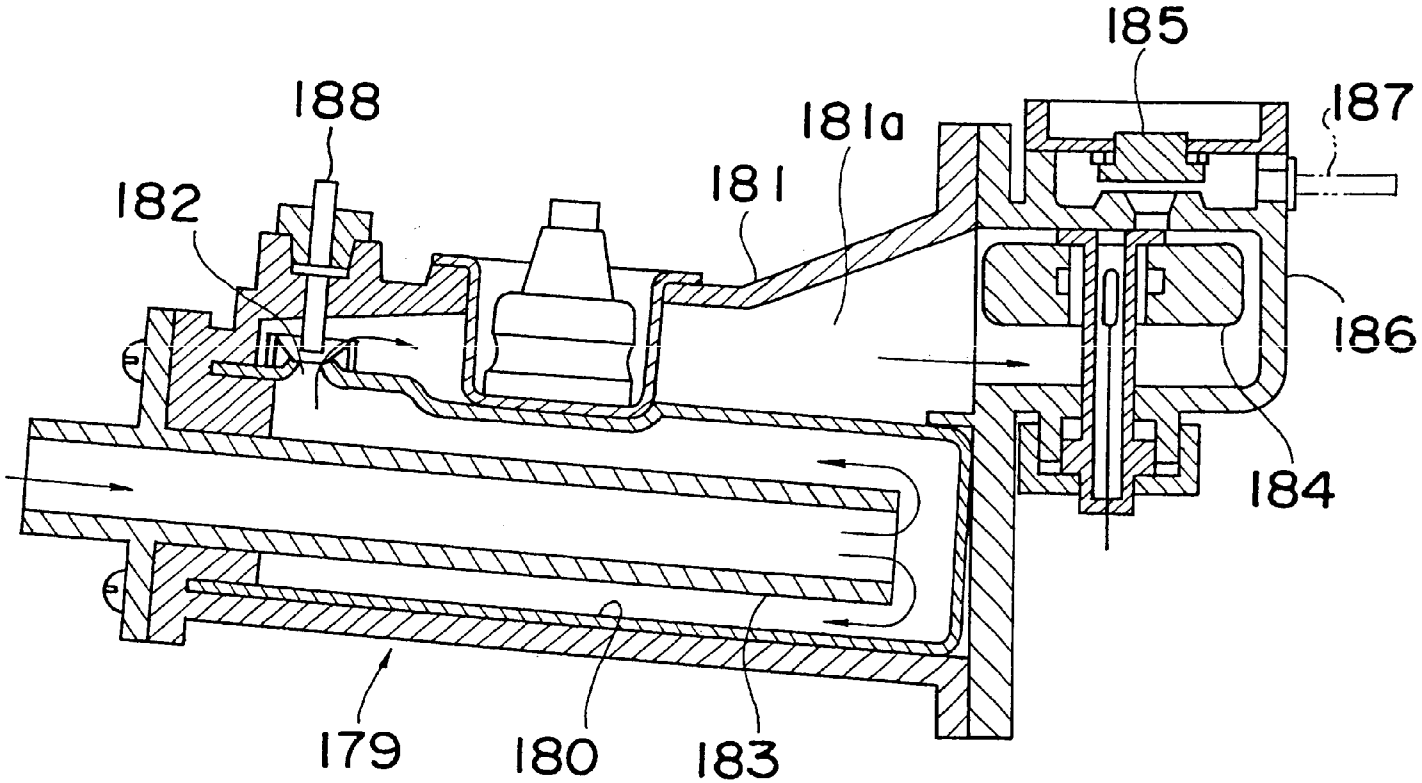
Fig.30 PRIOR ART
FIG. 30 is a schematic sectional view of a still further prior art human privates washing apparatus.
Figure 31:
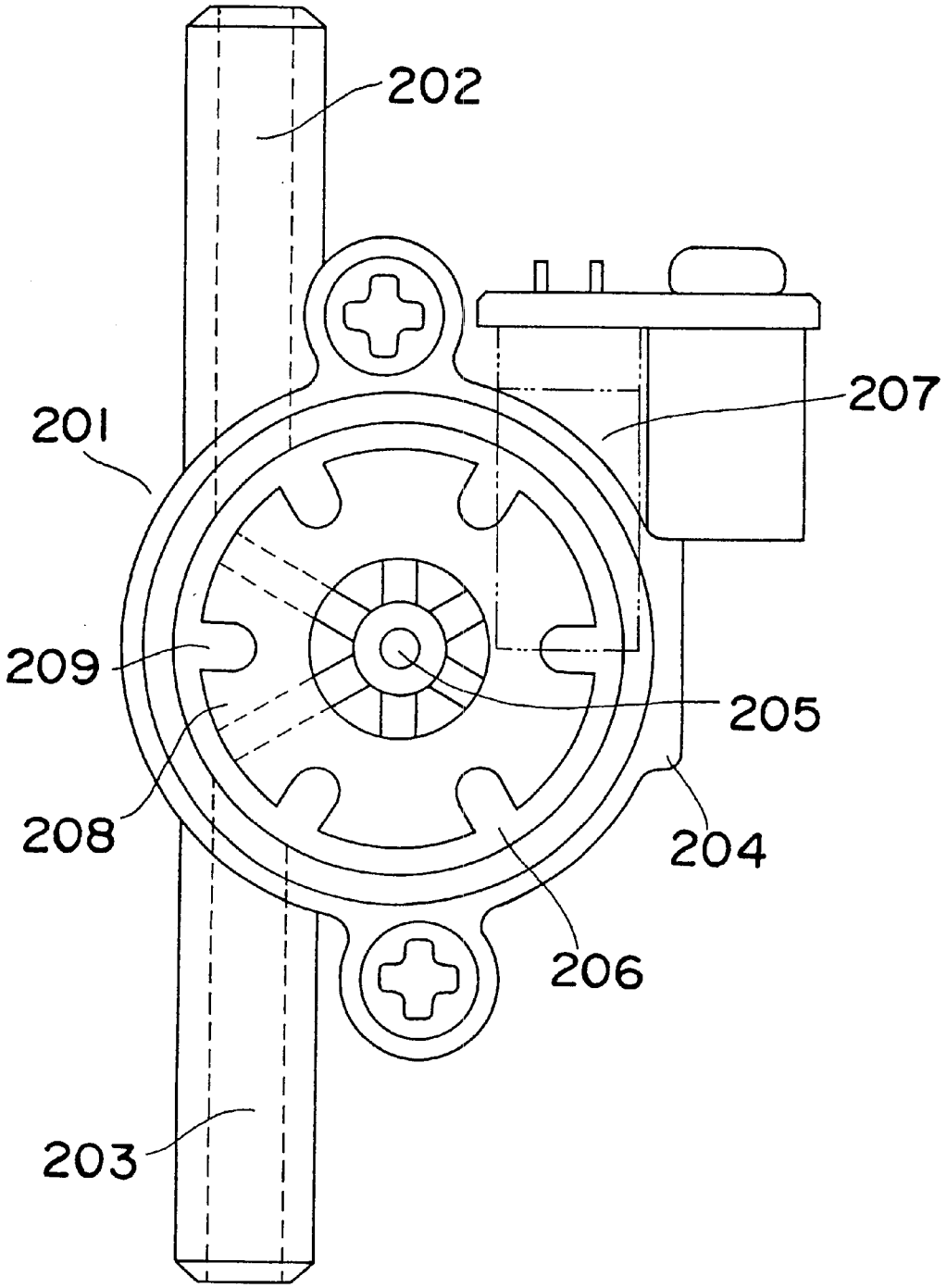
Fig.31 PRIOR ART
FIG. 31 is a partially cutaway front elevational view of a conventional flow rate sensor.
Figure 32:
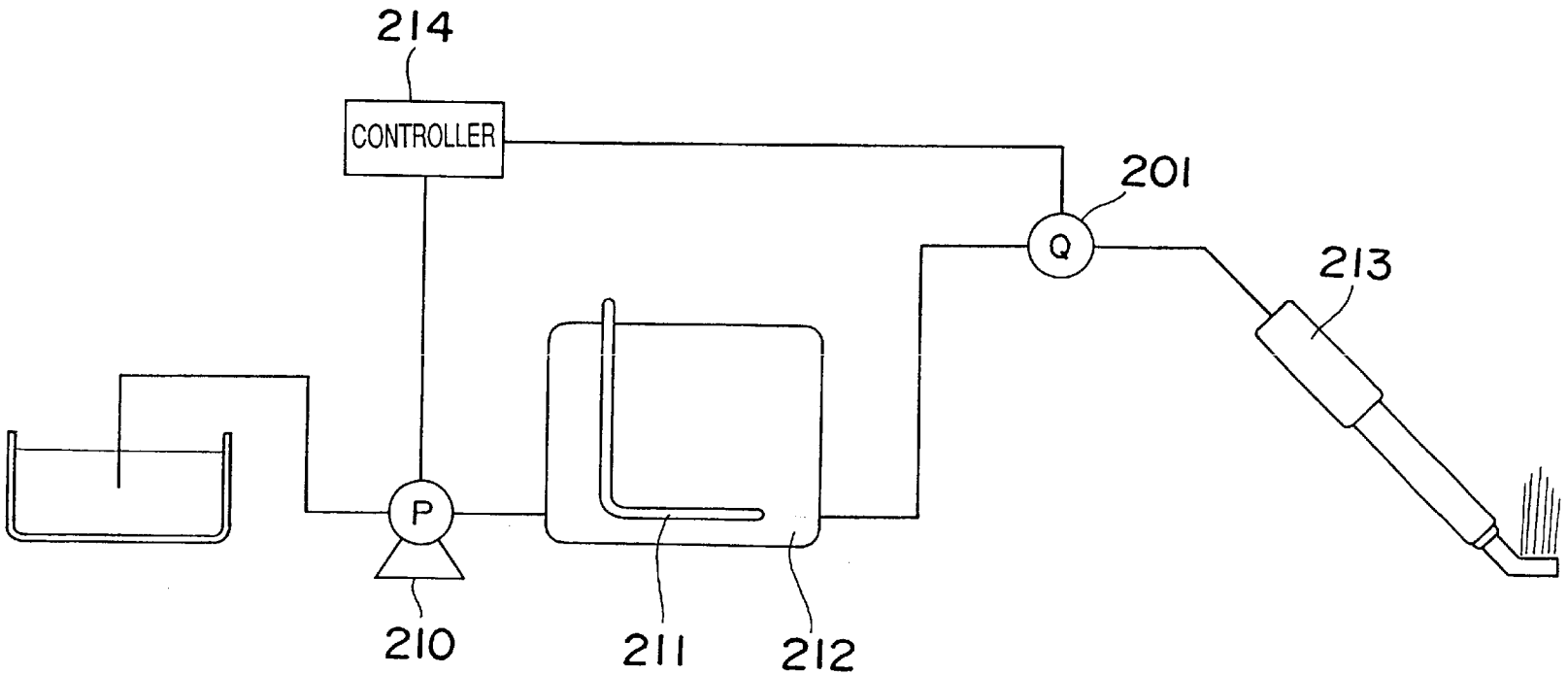
Fig.32 PRIOR ART
FIG. 32 is a schematic view showing an arrangement of a conventional human privates washing apparatus employing the flow rate sensor of FIG. 31.

FIGS. 26 and 27 are a sectional view and a front elevational view of a flow rate sensor 116 employed in a human privates washing apparatus according to an eleventh embodiment of the present invention, respectively. In FIGS. 26 and 27, a housing 117 is made of transparent material and has therein a substantially cylindrical chamber 118 connected with an inflow path 119 and an outflow path 120. In the chamber 118, a rotor 122 having six rotary vanes 121 extending radially from its axis at regular angular intervals and having an identical shape is rotatably supported by a shaft 123 and is arranged to be rotated by fluidal force exerted by fluid having entered from the inflow path 119. Meanwhile, a pair of bosses 124 are provided around the axis of the rotor 122. When the rotor 122 is displaced leftwards or rightwards in FIG. 26, the bosses 124 are brought into contact with the housing 117 such that the rotary vanes 121 do not come into direct contact with the housing 117. Furthermore, the inflow path 119 is parallel to a tangent of a rotational circle defined by the rotor 122 and is disposed at a location spaced a predetermined distance from an outer periphery of the rotary circle towards the shaft 123. In addition, the outflow path 120 is provided such that fluid entering from the inflow path 119 is discharged in parallel with the shaft 123 inwardly of the outer periphery of the rotational circle of the rotor 122, i.e., at one side of the outer periphery of the rotational circle of the rotor 122 adjacent to the shaft 123. Meanwhile, a photo interrupter 125 acting as a means for detecting the number of revolutions is provided on the housing 117. In the photo interrupter 125, a light emitting diode 126 acting as a light emitting element and a photo diode 127 acting as a photosensor confront each other so as to have an optical axis parallel to the shaft 123. Moreover, a temperature thermistor 128 and an arithmetic unit 129 which act as output correcting means are provided in the course of the inflow path 119 such that output of the photo interrupter 125 is corrected in accordance with output of the temperature thermistor 128.

Operation of the flow rate sensor 116 of the above described arrangement is described. Initially, fluid entering from the inflow path 119 is curved along the shape of the chamber 118 and flows by drawing a substantially U-shaped streamline as shown by the arrow in FIG. 27. Then, the fluid is discharged in parallel with the shaft 123 inwardly of the outer periphery of the rotational circle of the rotor 122, i.e., at one side of the outer periphery of the rotational circle of the rotor 122 adjacent to the shaft 123. Since the rotor 122 having the six rotary vanes 121 is rotatably supported by the shaft 123 in the chamber 118 at this time, fluid exerts fluidal force on the rotary vanes 121 so as to clockwise rotate the rotor 122 about the shaft 123 in FIG. 27. Since fluid exerts fluidal force on a plurality of the rotary vanes 121 at all times even if rotational angular position of the rotor 122 changes, scatter of rotational force applied to the rotor 122 as a whole is reduced and thus, the rotor 122 is rotated stably at all times. Meanwhile, since a plurality of the rotary vanes 121 are subjected to fluidal force, rotational force is increased and thus, the rotor 122 can be rotated even at a minute flow rate. In addition, if air bubbles adhere to the rotary vanes 121 provided on the rotor 122, such a problem might arise that since the air bubbles are thrust to base portions of the rotary vanes 121 by centrifugal force of rotation of the rotor 122, it is difficult to discharge the air bubbles. However, in this embodiment, since the outflow path 120 is provided in parallel with the shaft 123 and inwardly of the rotational circle of the rotor 122, i.e., at one side of the rotational circle of the rotor 122 adjacent to the shaft 123, the air bubbles are readily discharged without remaining on the rotor 122 for a long time.

Meanwhile, light irradiated from the light emitting diode 126 is transmitted through the transparent housing 117 and reaches the photo diode 127 provided at an opposed position. At the time the rotary vanes 121 pass across the optical axis, light is intercepted by a thickness of each of the rotary vanes 121 in a tangential direction of the rotational circle of the rotor 122, so that output of the photo diode 127 changes and thus, the number of revolutions of the rotor 122 is detected by counting these output changes. Meanwhile, since the six votary vanes 121 are provided, six output changes of the photo diode 127 are counted during one rotation of the rotor 122, so that minute changes of flow rate, etc. can be detected positively and thus, accuracy of detection of flow rate is improved greatly. Furthermore, if temperature of fluid changes, the number of revolutions of the rotor 122 changes upon change of viscosity of fluid. However, the arithmetic unit 129 corrects this error in accordance with output of the temperature thermistor 128 s0 as to output accurate signals of flow rate.

By the arrangement of this embodiment, since fluid entering from the inflow path 119 is discharged from the outflow path 120 through the rotational circle of the rotor 122 so as to draw the substantially U-shaped streamline, the rotor 122 is subjected to large fluidal force. Therefore, since the rotor 122 is rotated even at a minute flow rate and is rotated uniformly and stably, minute flow rate can be detected highly accurately. Meanwhile, since the outflow path 120 is provided in parallel with the shaft 123 and inwardly of the rotational circle of the rotor 122, i.e., at one side of the rotational circle of the rotor 122 adjacent to the shaft 123, air bubbles are readily discharged without remaining on the rotor 122 for a long time, so that rotational nonuniformity of the rotor 122 due to adhesion of air bubbles thereto is lessened and thus, the rotor 122 can be rotated smoothly and positively. In addition, since the bosses 124 are provided around the axis of the rotor 122, the rotary vanes 121 are not brought into direct contact with the housing 117 even if the rotor 122 is displaced laterally in FIG. 26, resistance to rotation of the rotor 122 can be reduced greatly. Meanwhile, since the arithmetic unit 129 corrects output of the photo interrupter 125 in accordance with output of the temperature thermistor 128, it is possible to perform accurate detection of flow rate having little error due to temperature change of fluid.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom. Industrial Applicability In the human privates washing apparatus according to the first embodiment of the present invention, the following effects can be gained.

(1) Since amount of air mixed into wash water is changed in response to control of flow rate of wash water, it is possible to prevent retention of air at the heating means or the hot water pipe and deterioration of bodily sensation and washing capability, which are caused by improper air mixing ratio. Meanwhile, since the user need not perform a plurality of operations, operation is made simple and convenient. Since loss due to heat dissipation is lessened by heating wash water by the instantaneous heating type heating means only in case of necessity and amount of wash water is reduced by mixing air thereinto, power consumption is reduced greatly.

(2) Since air mixing amount is controlled in accordance with flow rate detected by the flow rate detecting means for detecting amount of wash water, ratio of amount of air mixed into wash water to amount of the wash water can be set properly and the air mixing means can be stopped in response to suspension of water supply, etc. Therefore, it is possible to prevent local boiling or abnormal heating due to flow of air into the heating means.

(3) Since proper setting of ratio of amount of air mixed into wash water to amount of the wash water and operation of the heating means are performed in accordance with flow rate detected by the flow rate detecting means, ratio of amount of air mixed into wash water to amount of the wash water can be set properly and the air mixing means can be stopped in response to suspension of water supply, etc., so that it is possible to prevent local boiling or abnormal heating due to flow of air into the heating means. In addition, by controlling the heating means by confirming that wash water is flowing positively, it is possible to prevent damage to the heating means even during long suspension of water supply.

(4) If the washing setting means is used without especially adding the flow rate detecting means structurally, the air mixing means and the heating means can be controlled in association with each other by only setting of the washing setting means. Furthermore, since it is possible to cope with a case in which the air mixing means and the heating means should be controlled immediately at the time of stop of supply of wash water, etc., late heating caused by residual heat and abnormal heating can be prevented.

(5) Since ratio of amount of air mixed into wash water is reduced by the air mixing means as amount of the wash water is reduced by the water supply controlling means, such a phenomenon can be prevented that air bubbles become larger in diameter at the time of reduction of amount of the wash water due to drop of internal pressure of the hot water pipe leading to the discharge means. Hence, it is possible to prevent deterioration of bodily sensation.

(6) Since ratio of amount of air mixed into wash water is increased by the air mixing means as amount of the wash water is reduced by the water supply controlling means, it is possible to deal with a use in which stimulative sensation is desired especially at low flow rate. Moreover, further saving of water and further reduction of power consumption can be achieved.

(7) By changing ratio of amount of air mixed into wash water to amount of the wash water through selection by the selection means, washing capability corresponding to not only preference of bodily sensation variable according to sites of the privates but purposes for use can be selected, thereby resulting in promotion of the user's convenience.

(8) Since air from the air mixing means is mixed into hot water between the heating means and the washing nozzle, it is possible to prevent local boiling and abnormal heating which are caused by retention of air bubbles in the heating means. Meanwhile, it is possible to prevent not only such a phenomenon that air bubbles mixed into water are formed integrally to larger diameter and give intermittent sensation to the user when injected from the washing nozzle but scattering of hot wash water. Furthermore, since the heating means is of instantaneous heating type, water may be heated only when washing is needed, so that loss due to heat dissipation can be reduced and thus, power consumption can be lessened.

(9) By performing heating by the heating means only when flow of water or hot water has been detected by the flow rate detecting means, it is possible to secure safety and reliability of the apparatus in the case where a large amount of air has been supplied or water supply has been suspended.

(10) Since the controller causes the water supply controlling means to stop water supply if temperature detected by the temperature detecting means has exceeded the predetermined value, it becomes possible to stop supply of high-temperature water in the case where-temperature of hot water has exceeded the predetermined value at the time of failure of a heating control system of the heater or drop of flow rate, so that safety can be secured in the case of malfunctioning.

(11) By heating the heating means itself by the heating means when washing is not being performed, it becomes possible at the time of washing to supply in a short period hot water having a desired temperature. If heating is not performed by the heating means when presence of air is detected by the air detecting means, heating is not performed without water, thereby resulting in greater safety of the apparatus.

(12) By providing the selection means for performing heating by the heating means when water or hot water is not flowing, the user can arbitrarily select heating by the heating means when water or hot water is not flowing, thus resulting in improvement of operational convenience.

(13) By detecting proximity of the user to the toilet seat by the proximity detecting means so as to perform heating by the heating means when washing is not performed, selection can be made without the need for the user's additional operation, so that unnecessary preheating is prevented and operating efficiency is improved further.

Meanwhile, the water heaters of the human privates washing apparatuses according to the second to ninth embodiments of the present invention have the following effects.

(1) Since the water heater includes the flat platelike heating means, the water inlet for receiving water, the hot water outlet for discharging hot water heated by the flat platelike heating means and the meandering water passage which is communicated with the water inlet and the hot water outlet, has at least one bent portion and is disposed in thermal contact with the flat platelike heating means, hot water having a fixed temperature can be discharged for a long time by the instantaneous heating type water heater.

Meanwhile, since flow velocity and heat transfer rate can be increased by reducing cross-sectional area of the meandering water passage while heat transfer area is secured, the water heater can be made for higher load and more compact at high thermal efficiency and in simple construction. Furthermore, since the water storage portion is not provided, the water heater has high temperature raise speed and more excellent control response.

(2) Since the flat platelike heating means is formed by the ceramic heater in which the heating element producing Joule's heat by supplying electric power thereto is gripped between a pair of the ceramic plates made of alumina or the like, the ceramic heater is formed by alumina which is an electrical insulator and has a large thermal conductivity, so that temperature raise speed of the flat platelike heating means itself is high. As a result, since temperature raise and temperature control response of hot water can be performed in a moment and the meandering water passage may be arranged such that water is brought into direct contact with the ceramic heater, temperature raise speed and response can be improved further and thermal efficiency also can be improved.

(3) Since the fuel passage for passing therethrough fuel such as hydrocarbon fuel and the catalytic combustion portion for oxidizing the fuel so as to produce heat therefrom are provided between the flat plates in the flat platelike heating means, it is possible to materialize the instantaneous heating type compact water heater having a simple construction and employing the fuel such as the hydrocarbon fuel. Since catalytic combustion is employed, the water heater emits clean exhaust gas without producing nitrogen oxides.

(4) Since the resinous heat exchange portion having the meandering water passage is provided, thermal capacity of the heat exchange portion is lessened, so that thermal capacity of the water heater as a whole is not increased and thus, temperature raise speed and temperature control response of hot water can be improved.

(5) Since the meandering water passage is provided with the water inlet and the hot water outlet and the inflow path adjacent to the water inlet and the outflow path adjacent to the hot water outlet are provided next to each other in the meandering water passage, heat exchange is performed by temperature difference also between the inflow path and the outflow path, so that temperature difference in the meandering water passage is mitigated and thus, distribution of temperature over the heat transfer faces of the flat platelike heating means is made more uniform. As a result, fracture of the ceramic heater due to thermal strain can be prevented.

(6) Since the flat platelike heating means is disposed substantially vertically and the water inlet and the hot water outlet are, respectively, provided at the substantially lowermost end and the substantially uppermost end of the meandering water passage, the meandering water passage is directed sequentially upwardly from the water inlet to the hot water outlet. Therefore, even if air bubbles are produced through separation of dissolved oxygen from water upon rise of temperature of the water, the air bubbles are carried to the hot water outlet by buoyancy so as to be discharged from the hot water outlet, so that hot water is discharged steadily without turbulence in flow of the discharged hot water due to the air bubbles such that the water heater can be operated safely. In addition, it is possible to prevent drop of heat transfer rate due to the air bubbles in the water heater and drop of thermal efficiency. Furthermore, since such a phenomenon is eliminated that air bubbles formed integrally to larger diameter remain at a spot in the meandering water passage and heat transfer rate drops suddenly at the spot so as to cause local heat shock, safety of the flat platelike heating means can be improved.

(7) Since the meandering water passage extends beyond the outer boundary of the heating portion of the flat platelike heating means, the water passage is present over a range wider than that of the heating portion of the flat platelike heating means. Therefore, since such a phenomenon is prevented that heat flow is transferred to the constituent members of the water heater without being absorbed by water and a portion, for example, an end portion of the water heater reaches abnormally high temperature, thermal efficiency and safety can be improved.

(8) Since the branch portion disposed upstream of the meandering water passage and the confluent portion disposed downstream of the meandering water passage are provided and water is caused to flow through the meandering water passages on the opposite faces of the flat platelike heating means, temperature gradient is not produced between the opposite faces of the flat platelike heating means and warpage or fracture of the flat platelike heating means due to thermal strain is prevented, thereby resulting in improvement of safety.

(9) The heat transfer plate having a large thermal conductivity is provided between the flat platelike heating means and the meandering water passage. Therefore, even if gradient distribution of temperature is produced in a plane between the meandering water passage and the heat transfer plate by water flow, the gradient distribution of temperature is, before being transferred to the surface of the flat platelike heating means, mitigated by the heat transfer plate having the large thermal conductivity, so that distribution of temperature on the surface of the flat platelike heating means is made more uniform and thus, fracture of the ceramic heater due to thermal strain can be prevented.

(10) Since the water heater includes the flat platelike heating means in which the electric heaters of two or more circuits connected in parallel are provided in one flat plate, the temperature detecting means for detecting temperature of discharged hot water and the controller for controlling ratios of electric power supplied to the electric heaters, the electric heaters are formed by a plurality of the circuits connected in parallel, so that wattage of the electric heater per circuit is reduced. As a result, since ratio of electric power supplied to each circuit having the small wattage is controlled, control resolution is improved remarkably so as to enable elaborate temperature control and heat shock is also reduced, so that reliability of the electric heater can be improved by lengthening its service life. Meanwhile, in case cycle control method is employed in which the number of cycles is adjusted in a control period of a fixed duration and ratios of electric power supplied to the electric heaters is controlled by repeating the control period, each electric heater having the small wattage may be turned on and off cyclically, so that variations of voltage of the power source line can be restricted small. As a result, flicker of illumination, etc. can be prevented and temperature variations uncomfortable for the user of the water heater can be restrained.

(11) Since the turbulent flow generator is provided in the meandering water passage, heat transfer rate from the flat platelike heating means to water can be improved by the turbulent flow generator, so that heat transfer area can be lessened and thus, the water heater can be made for higher load and more compact by using the flat platelike heating means having large watt density.

Furthermore, the flow rate sensors of the human privates washing apparatuses according to the tenth and eleventh embodiments have the following effects.

(1) Since fluid entering from the inflow path is discharged from the outflow path by drawing the substantially U-shaped streamline along the rotational circle of the rotor, the rotor is subjected to large fluidal force and thus, can be rotated even at minute flow rate. Since the number of revolutions is detected by the means for detecting the number of revolutions, minute flow rate can be detected highly accurately.

(2) Since not only the center of gravity of the rotary vanes coincides with the axis of the rotor but a plurality of the rotary vanes are arranged at the regular angular intervals, scatter of rotational force according to rotational angular position of the rotor is small. Furthermore, since fluid entering from the inflow path exerts fluidal force on the rotary vanes positively, the rotor is rotated smoothly and positively and thus, minute flow rate can be detected highly accurately.

(3) Since the rotor has a simple construction, resistance to rotation of the rotor is small. Meanwhile, since adhesion of air bubbles to the rotary vanes can be prevented and air bubbles adhering to the rotary vanes can be readily separated from the rotary vanes, the rotor can be rotated smoothly and positively and thus, minute flow rate can be detected highly accurately.

(4) Since the outflow path is provided in parallel with the axial direction of the rotor, air bubbles adhering to the rotary vanes of the rotor are readily discharged without being thrust towards the axis of the rotor, so that rotational nonuniformity of the rotor due to adhesion of air bubbles thereto is lessened and thus, minute flow rate can be detected highly accurately.

(5) The outflow path is provided at one side of the outer periphery of the rotor adjacent to its axis. Therefore, also when bubbles adhere to vicinity of the axis of the rotor, the air bubbles are readily discharged, so that rotational nonuniformity of the rotor due to adhesion of the air bubbles thereto is reduced and thus, minute flow rate can be detected highly accurately.

(6) The bosses are provided around the axis of the rotor. Therefore, when the rotor is rotated while being depressed in one of opposite axial directions, frictional resistance of the housing relative to the rotor is minimized, so that the rotor is rotated smoothly and positively and thus, minute flow rate can be detected highly accurately.

(7) since the temperature thermistor detects temperature of fluid and the arithmetic unit corrects output of the means for detecting the number of revolutions, flow rate can be detected highly accurately independently of temperature of fluid.

We claim:

1. An apparatus for washing human privates, said apparatus comprising:

a water heater which is connected with a water supply pipe and a hot water pipe;

a water supply controlling means for controlling supply of the wash water to the water heater;

a discharge means for discharging to the human privates the wash water heated to a proper temperature by the water heater, which is connected with the hot water pipe;

an air mixing means for mixing air into the wash water;

a controller for controlling so as to change, in response to control of the supply of the wash water by the water supply controlling means, an amount of the air mixed into the wash water by the air mixing means, wherein, at the time of use of the wash water, the water heater heats the wash water to the proper temperature during flow of the wash water from the supply pipe to the hot water pipe;

a flow rate detecting means for detecting a flow rate of the wash water, wherein the controller controls operation of the water heater in accordance with the flow rate detected by the flow rate detecting means, wherein the flow rate detecting means comprises a rotor which includes a plurality of rotary vanes extending radially from its axis at regular angular intervals and having an identical shape, a housing which has a substantially cylindrical chamber for receiving the rotor, an inflow path which causes the wash water to flow into the chamber in a tangential direction of a rotational circle of the rotor, an outflow path which is provided at such a position that a streamline drawn by the wash water flowing into the chamber from the inflow path defines a substantially U-shaped locus along the rotational circle of the rotor, and a detection means for detecting the number of revolutions of the rotor, wherein the detection means includes a light emitting element and a photosensor, and the light emitting element and the photosensor have an optical axis parallel to the axis of the rotor such that interceptions of light between the light emitting element and the photosensor by a thickness of each of the rotary vanes in the tangential direction of the rotational circle of the rotor are counted by the light emitting element and the photosensor.

2. An apparatus as claimed in claim 1, wherein a boss is provided in the vicinity of the axis of the rotor and the outflow path is formed in parallel with the axis of the rotor and inwardly of an outer periphery of the rotor.

3. An apparatus as claimed in claim 1, wherein the flow rate detecting means is provided upstream of the water heater.

4. An apparatus for washing human privates, said apparatus comprising:

a water heater which is connected with a water supply pipe and a hot water pipe;

a water supply controlling means for controlling supply of the wash water to the water heater;

a discharge means for discharging to the human privates the wash water heated to a proper temperature by the water heater, which is connected with the hot water pipe;

an air mixing means for mixing air into the wash water;

a controller for controlling so as to change, in response to control of the supply of the wash water by the water supply controlling means, an amount of the air mixed into the wash water by the air mixing means, wherein, at the time of use of the wash water, the water heater heats the wash water to the proper temperature during flow of the wash water from the supply pipe to the hot water pipe; and a flow rate detecting means for detecting a flow rate of the wash water, wherein the controller controls operation of the water heater in accordance with the flow rate detected by the flow rate detecting means, wherein the flow rate detecting means comprises a rotor which includes a plurality of rotary vanes extending radially from its axis at regular angular intervals and having an identical shape, a housing which has a substantially cylindrical chamber for receiving the rotor, an inflow path which causes the wash water to flow into the chamber in a tangential direction of a rotational circle of the rotor, an outflow path which is provided at such a position that a streamline drawn by the wash water flowing into the chamber from the inflow path defines a substantially U-shaped locus along the rotational circle of the rotor, and a detection means for detecting the number of revolutions of the rotor, wherein a boss is provided in the vicinity of the axis of the rotor and the outflow path is formed in parallel with the axis of the rotor and inwardly of an outer periphery of the rotor.

5. An apparatus as claimed in claim 4, wherein the flow rate detecting means is provided upstream of the water heater.

6. An apparatus for washing human privates, said apparatus comprising:

a water heater which is connected with a water supply pipe and a hot water pipe;

a water supply controlling means for controlling supply of the wash water to the water heater;

a discharge means for discharging to the human privates the wash water heated to a proper temperature by the water heater, which is connected with the hot water pipe;

an air mixing means for mixing air into the wash water;

a controller for controlling so as to change, in response to control of the supply of the wash water by the water supply controlling means, an amount of the air mixed into the wash water by the air mixing means, wherein, at the time of use of the wash water, the water heater heats the wash water to the proper temperature during flow of the wash water from the supply pipe to the hot water pipe; and a flow rate detecting means for detecting a flow rate of the wash water, wherein the controller controls operation of the water heater in accordance with the flow rate detected by the flow rate detecting means, wherein the flow rate detecting means comprises a rotor which includes a plurality of rotary vanes extending radially from its axis at regular angular intervals and having an identical shape, a housing which has a substantially cylindrical chamber for receiving the rotor, an inflow path which causes the wash water to flow into the chamber in a tangential direction of a rotational circle of the rotor, an outflow path which is provided at such a position that a streamline drawn by the wash water flowing into the chamber from the inflow path defines a substantially U-shaped locus along the rotational circle of the rotor, and a detection means for detecting the number of revolutions of the rotor, wherein the flow rate detecting means is provided upstream of the water heater.

7. An apparatus for washing human privates, said apparatus comprising:

a water heater which is connected with a water supply pipe and a hot water pipe;

a water supply controlling means for controlling supply of the wash water to the water heater;

a discharge means for discharging to the human privates the wash water heated to a proper temperature by the water heater, which is connected with the hot water pipe;

an air mixing means for mixing air into the wash water; and a controller for controlling so as to change, in response to control of the supply of the wash water by the water supply controlling means, an amount of the air mixed into the wash water by the air mixing means, wherein, at the time of use of the wash water, the water heater heats the wash water to the proper temperature during flow of the wash water from the supply pipe to the hot water pipe, wherein the water heater includes a flat platelike heating means, a water inlet, a hot water outlet and an internal flow path which is communicated with the water inlet and the hot water outlet, has at least one bent portion and is disposed in thermal contact with each of opposite faces of the heating means, wherein the heating means is formed by a ceramic heater in which a heating element producing Joule's heat by supplying electric power thereto is gripped between a pair of ceramic plates made of alumina or the like, wherein the water heater includes a heat exchange portion having the internal flow path and made of resinous material.

8. An apparatus for washing human privates, said apparatus comprising:

a water heater which is connected with a water supply pipe and a hot water pipe;

a water supply controlling means for controlling supply of the wash water to the water heater;

a discharge means for discharging to the human privates the wash water heated to a proper temperature by the water heater, which is connected with the hot water pipe;

an air mixing means for mixing air into the wash water; and a controller for controlling so as to change, in response to control of the supply of the wash water by the water supply controlling means, an amount of the air mixed into the wash water by the air mixing means, wherein, at the time of use of the wash water, the water heater heats the wash water to the proper temperature during flow of the wash water from the supply pipe to the hot water pipe, wherein the water heater includes a flat platelike heating means, a water inlet, a hot water outlet and an internal flow path which is communicated with the water inlet and the hot water outlet, has at least one bent portion and is disposed in thermal contact with each of opposite faces of the heating means, wherein the heating means is formed by a ceramic heater in which a heating element producing Joule's heat by supplying electric power thereto is gripped between a pair of ceramic plates made of alumina or the like, wherein the heating means is disposed substantially vertically and the water inlet and the hot water outlet are, respectively, provided at a substantially lowermost end and a substantially uppermost end of the internal flow path.

9. An apparatus for washing human privates, said apparatus comprising:

a water heater which is connected with a water supply pipe and a hot water pipe;

a water supply controlling means for controlling supply of the wash water to the water heater;

a discharge means for discharging to the human privates the wash water heated to a proper temperature by the water heater, which is connected with the hot water pipe;

an air mixing means for mixing air into the wash water; and a controller for controlling so as to change, in response to control of the supply of the wash water by the water supply controlling means, an amount of the air mixed into the wash water by the air mixing means, wherein, at the time of use of the wash water, the water heater heats the wash water to the proper temperature during flow of the wash water from the supply pipe to the hot water pipe, wherein the water heater includes a flat platelike heating means, a water inlet, a hot water outlet and an internal flow path which is communicated with the water inlet and the hot water outlet, has at least one bent portion and is disposed in thermal contact with each of opposite faces of the heating means, wherein the heating means is formed by a ceramic heater in which a heating element producing Joule's heat by supplying electric power thereto is gripped between a pair of ceramic plates made of alumina or the like, wherein the heating means includes at least two electric heaters arranged in parallel.

10. An apparatus for washing human privates, said apparatus comprising:

a water heater which is connected with a water supply pipe and a hot water pipe;

a water supply controlling means for controlling supply of the wash water to the water heater;

a discharge means for discharging to the human privates the wash water heated to a proper temperature by the water heater, which is connected with the hot water pipe;

an air mixing means for mixing air into the wash water; and a controller for controlling so as to change, in response to control of the supply of the wash water by the water supply controlling means, an amount of the air mixed into the wash water by the air mixing means, wherein the water heater includes a heating means, a water inlet, a hot water outlet, an internal flow path which is communicated with the water inlet and the hot water outlet, has at least one bent portion and is disposed in thermal contact with each of opposite faces of the heating means and a heat exchange portion made of resinous material and heats, at the time of use of the wash water, the wash water to the proper temperature during flow of the wash water from the supply pipe to the hot water pipe.

11. An apparatus as claimed in claim 10, wherein the heating means is disposed substantially vertically and the water inlet and the hot water outlet are, respectively, provided at a substantially lowermost end a substantially uppermost end of the internal flow path.

12. An apparatus as claimed in claim 10, wherein the heating means includes at least two electric heaters arranged in parallel.

13. An apparatus for washing human privates, said apparatus comprising:

a water heater which is connected with a water supply pipe and a hot water pipe;

a water supply controlling means for controlling supply of the wash water to the water heater;

a discharge means for discharging to the human privates the wash water heated to a proper temperature by the water heater, which is connected with the hot water pipe;

an air mixing means for mixing air into the wash water; and a controller for controlling so as to change, in response to control of the supply of the wash water by the water supply controlling means, an amount of the air mixed into the wash water by the air mixing means, wherein the water heater includes a heating means, a water inlet, a hot water outlet and an internal flow path which is communicated with the water inlet and the hot water outlet, has at least one bent portion and is disposed in thermal contact with each of opposite faces of the heating means, wherein the heating means is disposed substantially vertically and the water inlet and the hot water outlet are, respectively, provided at a substantially lowermost end and a substantially uppermost end of the internal flow path.

14. An apparatus as claimed in claim 13, wherein the heating means includes at least two electric heaters arranged in parallel.

15. An apparatus for washing human privates, said apparatus comprising:

a water heater which is connected with a water supply pipe and a hot water pipe;

a water supply controlling means for controlling supply of the wash water to the water heater;

a discharge means for discharging to the human privates the wash water heated to a proper temperature by the water heater, which is connected with the hot water pipe;

an air mixing means for mixing air into the wash water; and a controller for controlling so as to change, in response to control of the supply of the wash water by the water supply controlling means, an amount of the air mixed into the wash water by the air mixing means, wherein the water heater includes a heating means, a water inlet, a hot water outlet and an internal flow path which is communicated with the water inlet and the hot water outlet, has at least one bent portion and is disposed in thermal contact with each of opposite faces of the heating means, wherein the heating means includes at least two electric heaters arranged in parallel.

* * * * *